US007530305B2

(12) United States Patent
Toyoda et al.

(10) Patent No.: US 7,530,305 B2
(45) Date of Patent: May 12, 2009

(54) MOLDING MATERIAL TRANSFER METHOD AND SUBSTRATE STRUCTURE

(75) Inventors: Osamu Toyoda, Kawasaki (JP); Kazunori Inoue, Kawasaki (JP); Akira Tokai, Kawasaki (JP)

(73) Assignee: Hitachi Limited, Tokyo (JP)

( * ) Notice: Subject to any disclaimer, the term of this patent is extended or adjusted under 35 U.S.C. 154(b) by 376 days.

(21) Appl. No.: 11/174,459

(22) Filed: Jul. 6, 2005

(65) Prior Publication Data

US 2006/0021529 A1 Feb. 2, 2006

(30) Foreign Application Priority Data

Jul. 29, 2004 (JP) ..... 2004-221030

(51) Int. Cl.
*B41M 1/10* (2006.01)

(52) U.S. Cl. ..... 101/170; 101/251

(58) Field of Classification Search ..... 101/170, 101/251

See application file for complete search history.

(56) References Cited

U.S. PATENT DOCUMENTS

| | | | | |
|---|---|---|---|---|
| 6,113,836 | A * | 9/2000 | Sakai et al. | 264/400 |
| 6,964,528 | B2 * | 11/2005 | Korenaga et al. | 385/88 |
| 7,011,134 | B2 * | 3/2006 | Sung | 164/74 |
| 7,014,522 | B2 * | 3/2006 | Hibino et al. | 445/25 |
| 7,049,176 | B2 * | 5/2006 | Oda et al. | 438/119 |
| 7,243,599 | B2 * | 7/2007 | Yoo et al. | 101/170 |
| 7,264,526 | B2 * | 9/2007 | Kim et al. | 445/24 |
| 7,288,013 | B2 * | 10/2007 | Yokoyama et al. | 445/23 |
| 7,445,969 | B2 * | 11/2008 | Kuratomi et al. | 438/126 |
| 2006/0121815 | A1 | 6/2006 | Kim et al. | 445/24 |

FOREIGN PATENT DOCUMENTS

| | | |
|---|---|---|
| JP | 2002-245931 | 8/2002 |
| JP | 2002-329461 | 11/2002 |
| KR | 10-2004-0006709 | 1/2004 |

OTHER PUBLICATIONS

Tae-Jeong Chang, et al., "Barrier Rib Molding Process using Capillary Action," SID Digest (Society for Information Display), 2003, pp. 1011-1013.

* cited by examiner

*Primary Examiner*—Anthony H. Nguyen
(74) *Attorney, Agent, or Firm*—Staas & Halsey LLP

(57) ABSTRACT

The present invention provides a new and highly reliable substrate manufacturing technology for manufacturing a substrate with a protrusion pattern, which can decrease structural defects caused by involving bubbles when the protrusion pattern is formed, can improve the reliability of the product and the yield of the product, does not require off-line steps such as vacuum deaeration, and therefore improves the production efficiency and simplifies the steps. According to the present invention, a molding material paste is filled into the concave portions of an intaglio plate for filling, an intaglio plate for transfer on which a specific groove pattern is formed is partially contacted with the intaglio plate for filling, the molding material is filled into the grooves of the intaglio plate for transfer, then the molding material is transferred from the intaglio plate for transfer to a substrate as a protrusion pattern.

10 Claims, 22 Drawing Sheets

MOLDING MATERIAL TRANSFER METHOD AND SUBSTRATE STRUCTURE

CROSS-REFERENCE TO RELATED APPLICATIONS

This application is based upon and claims the benefit of priority from the prior Japanese Patent Application No. 2004-221030, filed on Jul. 29, 2004, the entire contents of which are incorporated herein by reference.

BACKGROUND OF THE INVENTION

1. Field of the Invention

The present invention relates to a technology for forming a protrusion pattern such as ribs on a substrate with ribs (barriers) to be used for a plasma display panel (PDP), for example.

2. Description of the Related Art

As an example of the case where a substrate with a protrusion pattern is required, a PDP will be described. A PDP is a self light emitting display panel where a pair of substrates (normally glass substrates) are disposed facing each other with a small space in between, and a discharge space is created inside by sealing the periphery thereof.

Generally in a PDP, ribs (protrusions) with a 150-250 μm height are formed in a repeated manner on a substrate to partition the discharge space. For example, in the case of a surface-discharge PDP which is suitable for color display by a phosphor, ribs having a pattern which can be seen as stripes when the PDP is viewed directly are formed on the substrate with equal spaces in between along the address electrode lines. By these ribs, discharge interference and cross-talk of colors are prevented.

As a general process to fabricate a PDP substrate having the above mentioned structure, the address electrode pattern is formed on the substrate, and the ribs are formed so as to be aligned to the electrode pattern. Various methods have been proposed and used for forming the ribs, but typical methods are a multilayer printing method, sandblast method, embedding method, photo-lithography method and transfer method, of which the transfer method, with which the lowest cost may be possible, has high expectations.

The transfer method is a method of forming the ribs or a method of simultaneously forming ribs and a dielectric layer on a substrate, using an intaglio plate for transfer having grooves for forming ribs. As a procedure, a molding material is filled into the surface of the intaglio plate for transfer, then the cured molding material that was filled is transferred to the substrate to form the ribs and the dielectric layer (e.g. Japanese Patent No. 3321129 (Claims), Japanese Patent Application Laid-Open NO. H8-273537 (Claims), and Japanese Patent Application Laid-Open No. 2001-191345 (Claims).

SUMMARY OF THE INVENTION

A problem of filling the molding material into the intaglio plate for transfer is that bubbles may enter the grooves for filling the molding material on the intaglio plate for transfer. As a result, the molding material is not filled into that part of the grooves, which may cause defects in the ribs (underfilled parts) after the transfer. This problem occurs because the bubbles entrain when the molding material is being filled into the grooves.

If the groove pattern of the intaglio plate for transfer is linear, and the molding material extends in the filling direction, or if the direction of the bubbles to escape is uniquely determined, when squeezing is performed for example, then the probability of the bubbles to remain is decreased by sequentially filling the molding material so as to push out the bubbles sequentially from the edge of the intaglio plate for transfer, but in the case of grooves being crossed such as the case of a lattice pattern, the bubbles which entrained cannot escape anywhere at the intersections, and often end up as bubble defects. A possible method is pushing out the bubbles by repeatedly squeezing many times, but this is not efficient. Also if the intaglio plate for transfer is made of a material that can be easily deformed, such as a silicone resin, then the intaglio plate for transfer itself may be damaged by the squeezing.

In such a case, a vacuum deaeration method for releasing bubbles by evacuating ambient air, after filling the molding material into the intaglio plate for transfer, has been used conventionally. This method, however, is very inefficient.

As a method which does not use the vacuum deaeration method, a method for filling the molding material into the intaglio plate for transfer without involving bubbles, utilizing the capillary phenomenon of the molding material, has been reported (see T. J. Chang: "Society for Information Display", '03, USA, issued by Society for Information Display, 2003, pp. 1011). This method utilizes a phenomenon that the molding material wets the wall face of grooves of the intaglio plate for transfer, but for this, it is considered that the supply amount of the molding material to the intaglio plate for transfer must be extremely small, and a method for controlling this at the industrial level has not yet been developed. Also in this method, the molding material is filled such that the molding material is sandwiched between the substrate and the intaglio plate for transfer, so it is extremely difficult to accurately control the film thickness of the dielectric layer in the case in which the dielectric layer and the ribs for the PDP are simultaneously formed.

It is an object of the present invention to provide a new and highly reliable technology for solving the above problems, and manufacturing a substrate with a protrusion pattern. The other objects and advantages of the present invention will be clarified by the description herein below.

According to some aspects of the present invention, provided are a molding material transfer method and a substrate manufacturing method, each comprising: filling a molding material paste into the concave portions of an intaglio plate for filling; partially contacting an intaglio plate for transfer on which a specific groove pattern is formed to the intaglio plate for filling; filling the molding material into the grooves of the intaglio plate for transfer; and transferring the molding material from the intaglio plate for transfer to a substrate as a protrusion pattern.

Preferable are that the curing process is performed for the molding material in the intaglio plate for transfer by heat, UV (ultraviolet) rays or by a combination of heat and UV rays; that after the molding material is filled into the grooves of the intaglio plate for transfer, the molding material attached to portions other than the grooves is removed, if necessary, and then a predetermined thickness of molding material is applied onto the surface of the intaglio plate for transfer; that the intaglio plate for filling is in the shape of a plane or cylindrical plane, and the intaglio plate for transfer is in the shape of a cylindrical plane or is bendable; that the pattern of the concave portions of the intaglio plate for filling and the pattern of the grooves of the intaglio plate for transfer have a corresponding positional relationship; that the length of the concave portion of the intaglio plate for filling in a direction along the groove width of the intaglio plate for transfer is larger than the groove width of the intaglio plate for transfer, or the depth of the grooves of the intaglio plate for transfer is deeper than the depth of the concave portion of the intaglio plate for filling, or the length of the concave portion of the intaglio plate for filling in a direction along the groove width of the intaglio plate for transfer is larger than the groove width of the intaglio plate for transfer, and the depth of the grooves of the intaglio plate for transfer is deeper than the depth of the concave portion of the intaglio plate for filling; that the pattern of the concave portions of the intaglio plate for filling is composed of dots; that the groove pattern of the intaglio plate for transfer is a stripe pattern; that the groove pattern of the intaglio plate for transfer is a wavy stripe pattern; that the pattern of the concave portion of the intaglio plate for transfer is a lattice pattern; that the protrusion pattern is linked with a uniform plane portion; that the heights of the protrusions are in a 150-250 μm range and the widths of the protrusions are in a 50-120 μm range; and that the thickness of the uniform plane portion is in a 10-30 μm range.

According to other aspects of the present invention, a substrate manufactured by the above manufacturing method, and a flat display panel and a flat display device using this substrate as the substrate with ribs are provided.

According to the above mentioned aspects of the present invention, a new and highly reliable technology for manufacturing a substrate with a protrusion pattern can be provided. The structural defects caused by the involvement of bubbles during the formation of the protrusion pattern can be decreased considerably, and the reliability of the product and the yield of the product can be improved. Since offline steps such as vacuum deaeration are unnecessary, the production efficiency can be improved and the processing steps can be simplified.

According to still other aspects of the present invention, a molding material transfer apparatus comprising one or more plate cylinders (or printing cylinders), an intaglio plate for filling, an intaglio plate for transfer, an intaglio-plate-for-transfer contacting mechanism for partially contacting the intaglio plate for filling and the intaglio plate for transfer, a molding material curing unit, and, if necessary, a film thickness adjustment mechanism for the molding material on the surface of the intaglio plate for transfer, and a substrate manufacturing apparatus comprising one or more plate cylinders, an intaglio plate for filling, an intaglio plate for transfer, a substrate, an intaglio-plate-for-transfer contacting mechanism for partially contacting the intaglio plate for filling and the intaglio plate for transfer, a substrate contacting mechanism for contacting the intaglio plate for transfer and the substrate, a molding material curing unit, and, if necessary, a film thickness adjustment mechanism for the molding material on the surface of the intaglio plate for transfer, are provided.

According to the above aspects of the present invention, apparatuses suitable for implementing the above molding material transfer method and substrate manufacturing method are provided.

According to the present invention, a new and highly reliable technology for manufacturing the substrate with a protrusion pattern can be provided. In addition to this, using the present invention has an effect that transfer of a material is possible without allowing the material to be transferred to attach to portions other than the grooves of the concave portion for filling or the grooves of the concave portion for transfer.

DESCRIPTION OF THE PREFERRED EMBODIMENTS

Figure 1:
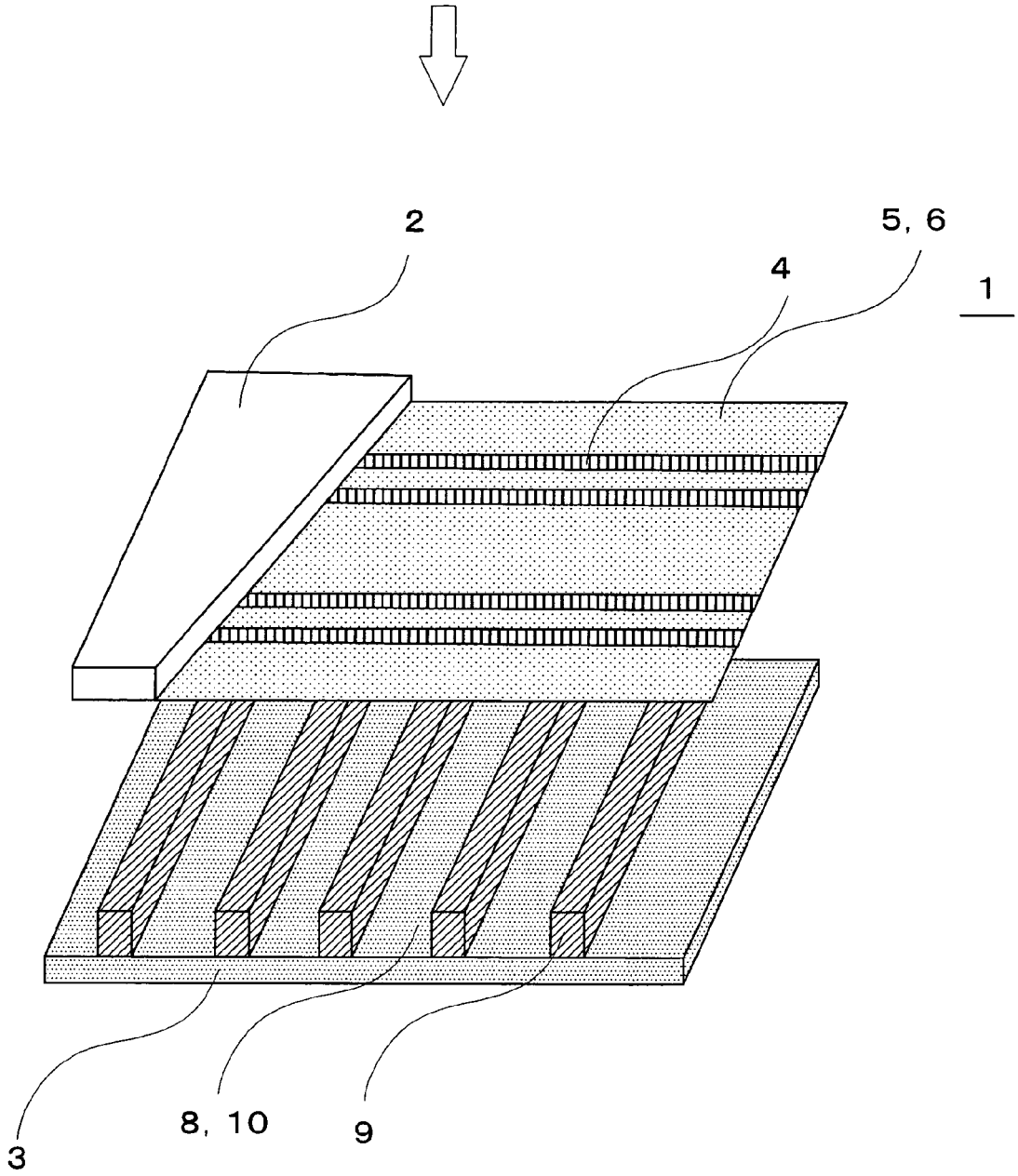
FIG. 1 is a schematic exploded view depicting an example of a PDP.

Embodiments of the present invention will now be described using drawings, examples, etc. These drawings, examples, etc. plus description are for illustrating the examples of the present invention, and shall not limit the scope of the present invention. Needless to say, other embodiments are within the scope of the present invention as long as they match the essential character of the present invention. In the drawings, the same elements are denoted with the same reference numerals or signs.

Figure 2:
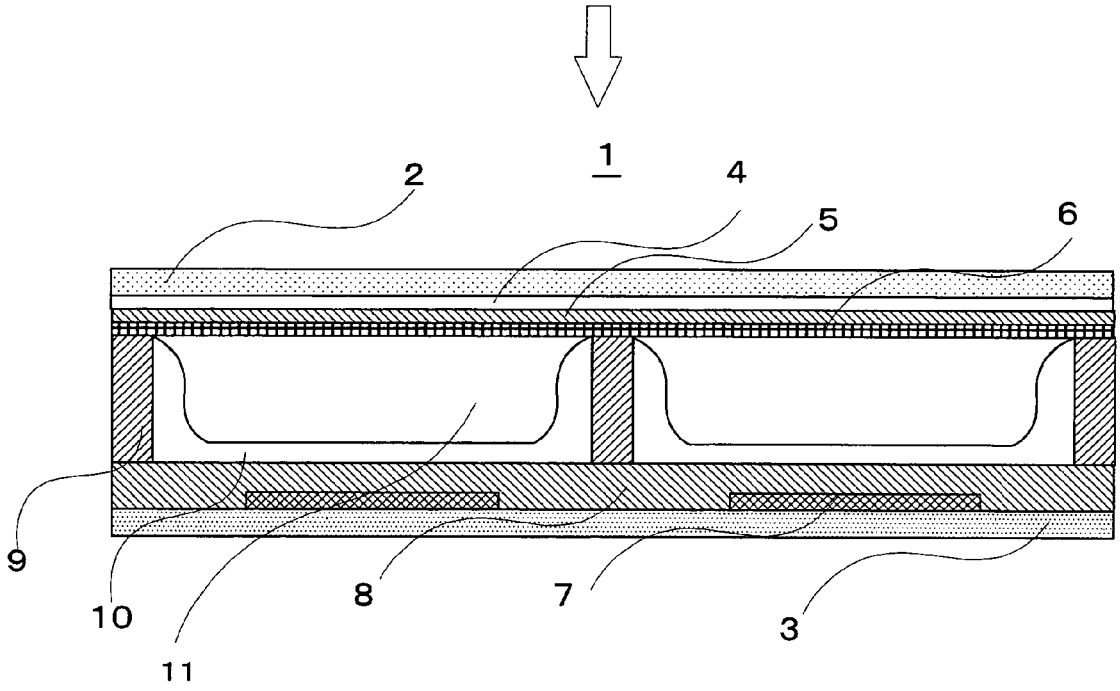
FIG. 2 is a schematic side cross-sectional view depicting an example of a PDP.

FIG. 1 is an exploded view of an example of a conventional PDP, and FIG. 2 is a side cross-sectional view thereof. In FIG. 1 and FIG. 2, the panel is seen from the direction along the arrow mark shown. The PDP 1 has a structure where a front substrate 2 and a back substrate 3 face each other. In this example, inside the front substrate 2 (side facing the back substrate 3), display electrodes 4, a dielectric layer 5 and a protective layer 6 for protecting the dielectric layer 5 are sequentially layered, and inside the back substrate 3 (side facing the front substrate 2), address electrodes 7 and a dielectric layer 8 are sequentially layered, and ribs 9 and a phosphor layer 10 are formed thereon. The dielectric layer 8 may be unnecessary in the case of a system in which discharging is caused by applying voltage between two display electrodes as shown in FIG. 2.

In the discharge space 11 enclosed by the dielectric layer 5, ribs 9 and phosphor layer 10, a gas for UV-ray emission such as neon gas or xenon gas is charged. The PDP 1 causes discharge by applying voltage between two display electrodes, exciting the gas for UV-ray emission to form a plasma status, and illuminating the phosphor of the phosphor layer 10 using the UV rays which are generated when the plasma status returns to the original status, so that display of visible lights is implemented. In the PDP, a color filter, electromagnetic wave shielding sheet, anti-reflection film, etc. are often installed. By installing an interface with a power supply unit and tuner unit to this PDP, a flat panel display device such as a large TV (plasma TV) set can be implemented.

For the substrate of the PDP, soda-lime glass and high-strain-point glass are used, for example. For the address electrodes, any metal having conductivity can be used. For the current PDP, silver, copper or aluminum is used as a metal the resistance of which is low and which hardly reacts with the dielectric layer. For the dielectric layer, a glass plate, a low-melting-point glass, etc. are used. The ribs 9 are made of a low-melting-point glass.

Figure 3:
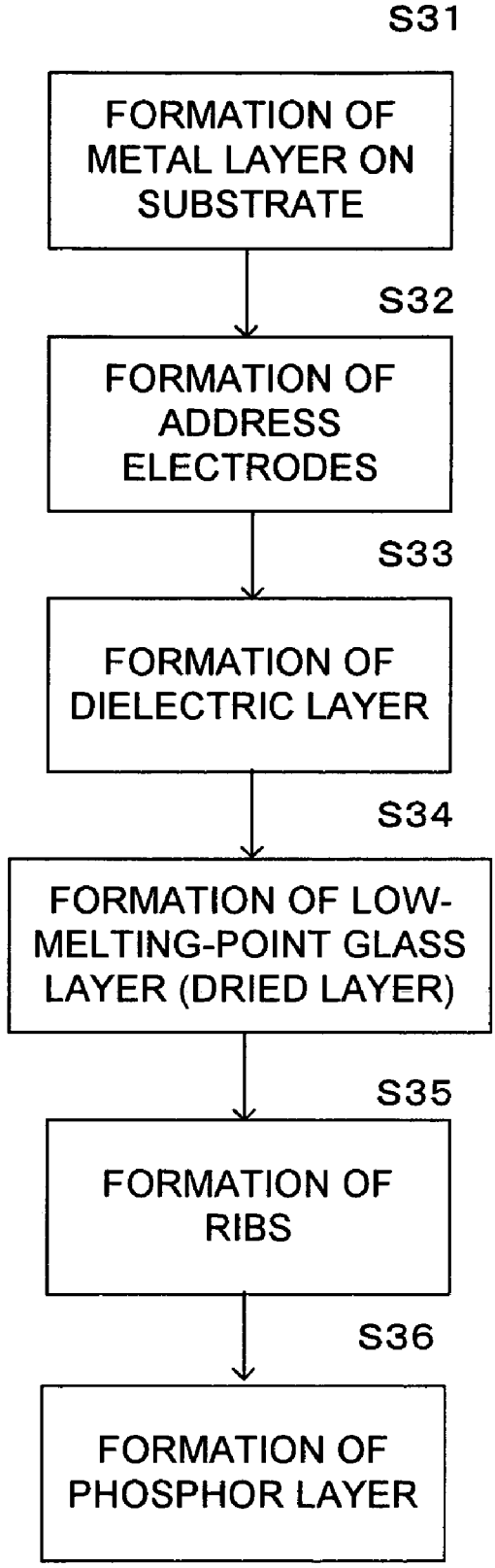
FIG. 3 is a flow chart depicting the sequence of forming address electrodes, a dielectric layer, ribs and a phosphor layer on the back substrate.

Inside the back substrate 3, the address electrodes 7, dielectric layer 8, ribs 9 and phosphor layer 10 are formed according to the following sequence, for example. At first, with reference to FIG. 3, a uniform metal layer is formed on the back substrate 3, as shown in step S31. Then as step S32 shows, unnecessary portions are removed and the address electrodes 7 having a specific pattern are formed. Then as step S33 shows, the dielectric layer 8 is formed. Then as step S34 shows, a uniform low-melting-point glass layer is formed. Then as step S35 shows, the ribs are formed by cutting the low-melting-point glass, and as step S36 shows, the phosphor is applied.

The present invention can be applied suitably to forming ribs, as protrusions, on a substrate used for flat display panels and flat display devices represented by PDP. However, the present invention can also be favorably applied, without being limited to these fields, to other fields where a protrusion pattern is created on a substrate. Particularly when the width of the protrusion pattern is narrow and the height thereof is high, the reliability is preferably high. Specifically, the present invention can be favorably applied to a 150-250 μm height range and a 50-120 μm width range. The protrusion interval is not critical, but is preferably 150-350 μm. These dimensions are those measured when the protrusions have been formed on a substrate. The three-dimensional shape of the protrusions may be of any shape, as long as the shape is not counter to the essential character of the present invention, but a rectangular parallelepiped shape as shown in FIG. 1 is preferable in the case of a PDP substrate. Angles may be tapered somewhat (draft angle) to make transfer to the substrate easier.

In the present invention, a "substrate" is not limited to the substrate for electronic equipment such as PDP but can be any plate if the plate is flat. The material of the substrate may be any material, unless the material is counter to the essential character of the present invention.

Figure 4:
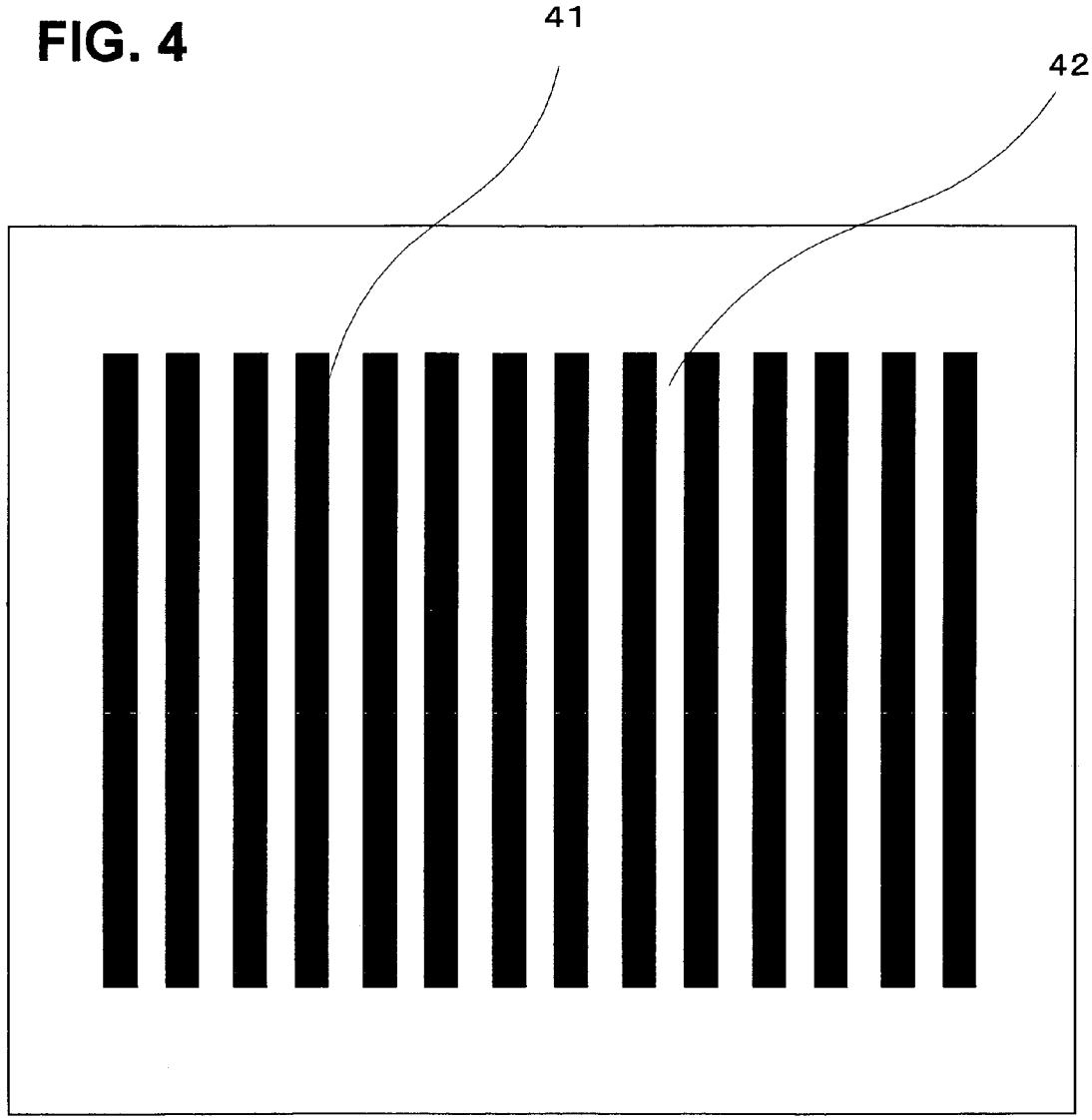
FIG. 4 is a schematic view depicting an example of the pattern according to the present invention.
Figure 5:
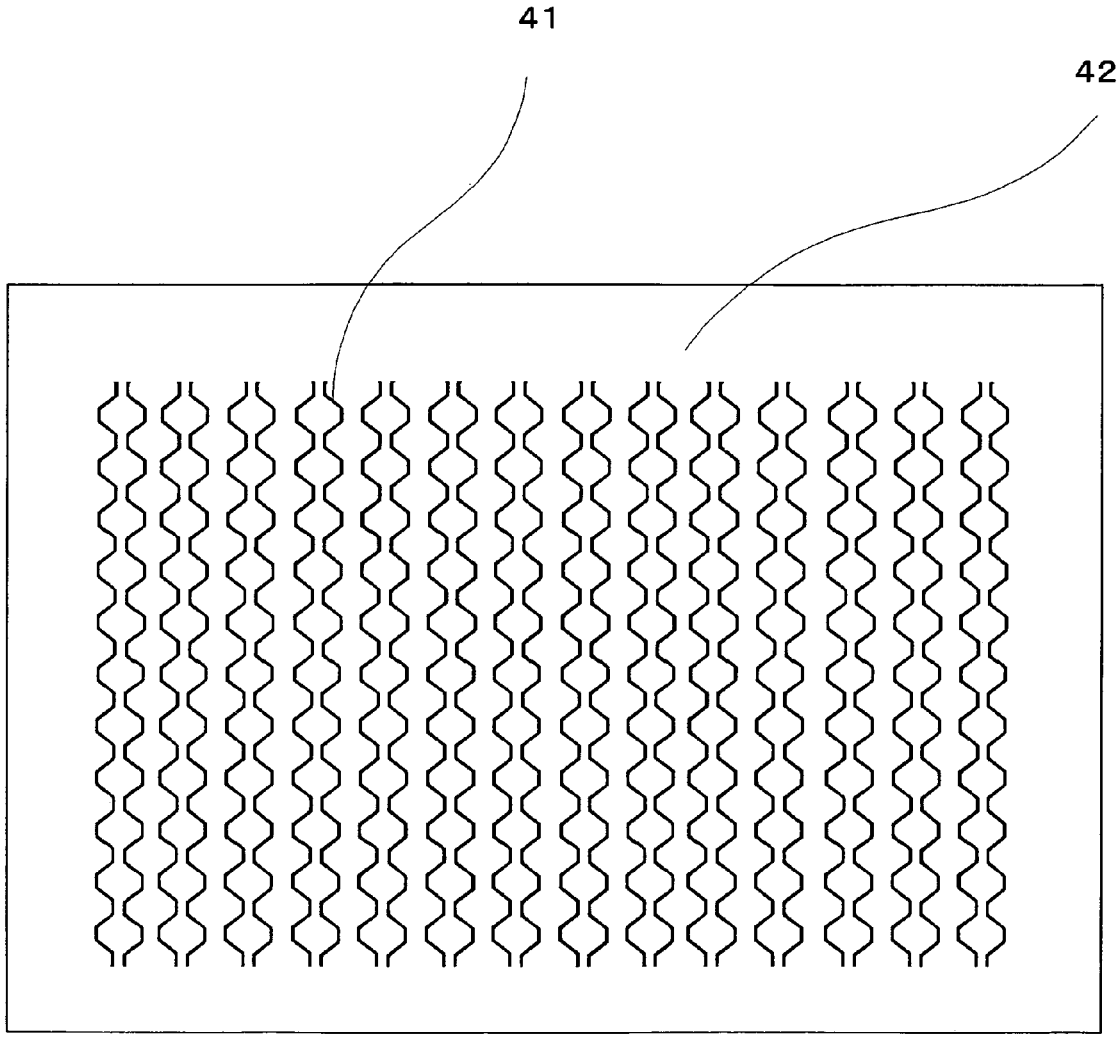
FIG. 5 is a schematic view depicting another example of a pattern according to the present invention.
Figure 6:
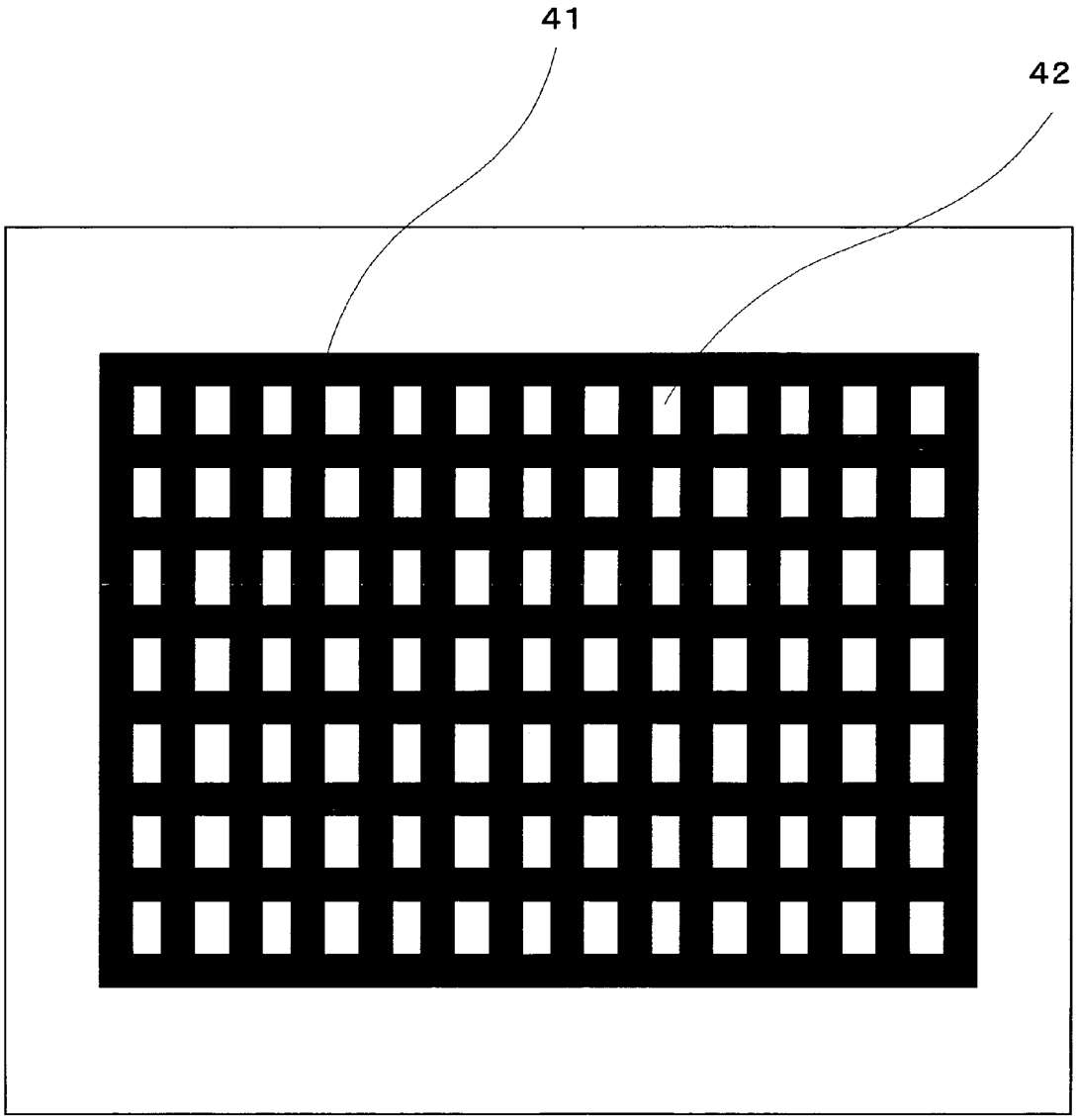
FIG. 6 is a schematic view depicting another example of a pattern according to the present invention.

In the present invention, "pattern" in the protrusion pattern, groove pattern, pattern of concave portions, etc. is a shape that can be recognized as having a specific repetitive shape when the target face (e.g. substrate face, face of an intaglio plate for transfer, or face of an intaglio plate for filling) is viewed. In the cases of a groove pattern of the intaglio plate for transfer and protrusion pattern on the substrate, more specifically, a repeated stripe shape shown in FIG. 4, a repeated wavy stripe shape shown in FIG. 5, and a repeated lattice shape shown in FIG. 6 when the target face is directly seen, can be used. In FIG. 4-FIG. 6, the reference numeral 41 indicates a protrusion pattern, and the reference numeral 42 is a base portion other than the protrusions (target face).

Figure 10:
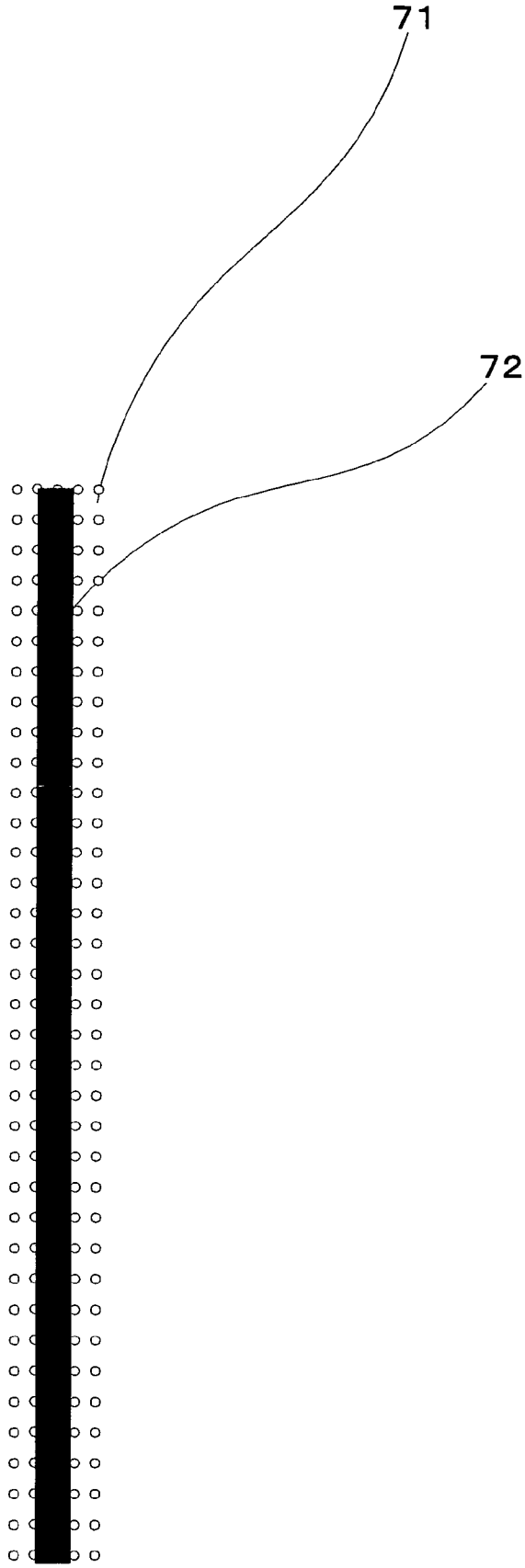
FIG. 10 is another schematic view depicting a status where the stripe pattern of the concave portions of an intaglio plate for filling and the stripe pattern of the grooves of an intaglio plate for transfer overlap.

The height of the strips and the lattice may be uniform, but a plurality of different heights may be included. In the case of the pattern of the concave portions of the intaglio plate for filling, a pattern with less regularity may be used besides the above examples. Those including a repetition of circular, elliptic, triangular, square or other polygonal, or irregular shaped concave portions may also be used. To fill the molding material into the intaglio plate for transfer with certainty, the pattern of the concave portions of the intaglio plate for filling is preferably dots as shown in FIG. 10. In the case of the concave portions of the intaglio plate for filling, it may also be useful that no pattern exists.

A molding material transfer method and a manufacturing method for a substrate that has a protrusion pattern according to the present invention will now be described.

According to the technology of the present invention, instead of directly filling a molding material onto the surface of an intaglio plate for transfer, a molding material paste is first filled into the concave portions of an intaglio plate for filling, then an intaglio plate for transfer on which a specific groove pattern is formed, is partially contacted to the intaglio plate for filling, and the molding material is filled into the grooves of the intaglio plate for transfer, thus the molding material is directly filled onto the surface of the intaglio plate for transfer. Then the molding material is transferred from the intaglio plate for transfer to the substrate as a protrusion pattern. By these operations, the molding material is transferred and a substrate with the protrusion pattern can be manufactured.

By this, using the molding material paste that has been filled into the concave portions of the intaglio plate for filling, by squeezing, for example, until bubbles disappear, the intaglio plate for transfer is partially contacted with the intaglio plate for filling to transfer the molding material, so that the molding material can be sufficiently filled into the grooves of the intaglio plate for transfer using the capillary phenomenon. The capillary phenomenon is regarded as has been occurred when the molding material is shifted from the intaglio plate for filling to the intaglio plate for transfer by partially contacting the intaglio plate for transfer to the intaglio plate for filling.

For the intaglio plate for filling, besides a mold fabricated by processing a metal by machining, laser processing, etching or the like, a glass mold fabricated by etching glass, can be used. For the material, one with high hardness is preferable to prevent abrasion when the molding material is filled into the intaglio plate for filling by a metal blade or ceramic blade. If a material such as glass or metal which has abrasive resistance and does not easily deform, is used, abrasion or deformation by squeezing or the like becomes of little concern, so it is easy to fill a molding material paste in until bubbles disappear. Also, as described later, the concave portions of the intaglio plate for filling can be set shallower or wider than the grooves of the intaglio plate for transfer, which also makes it easy to fill the molding material paste in until bubbles disappear.

For the intaglio plate for transfer, on the other hand, a soft material that can be released easily is preferable so that the shape of the molding material is not damaged at transfer. An example is a silicone rubber.

The amount of the molding material supplied into the grooves of the intaglio plate for transfer is determined by the space of the small concave portions formed on the intaglio plate for filling. Therefore, very small amounts of the molding material can be supplied each time, which prevents the bubbles being involved which occurs when the molding material is supplied excessively before the wall faces of the grooves of the intaglio plate for transfer become completely wet as the molding material is filled into the grooves of the intaglio plate for transfer by the capillary phenomenon. Therefore capillary phenomenon can be used with good reproducibility, and the vacuum deaeration step of the intaglio plate for transfer can be omitted. By this, the attachment of the material for transfer to areas other than the grooves of the intaglio plate for filling or the grooves of the intaglio plate for transfer can be prevented.

The portion in the grooves of the intaglio plate for transfer which was filled once without bubbles can be very easily wet, and even if the molding material is additionally filled thereafter, it is very rare that bubbles enter into the grooves. Therefore, even if the filling amount is insufficient in the first filling, the molding material can easily be added using the intaglio plate for filling filled with the molding material. A plurality of times of filling may be executed regardless of circumstances. If the filling amount is excessive, the molding material attached to areas other than the grooves can be removed when necessary.

It is also possible to apply the molding material with a predetermined thickness onto the face of the intaglio plate for transfer using a roll coating method, slit coating method, etc., and by this, a protrusion pattern linked with a uniform plane portion can be acquired. If these protrusions are used as the ribs and the uniform plane portion is regarded as the dielectric layer, this means, in a case of a PDP substrate, forming the ribs and the dielectric layer in combination at a time. This method is preferable since the thickness of the uniform plane portion can be adjusted freely. To make it easy to adjust the thickness of the uniform plane portion, it is preferable to fill the molding material into the grooves of the intaglio plate for transfer, remove the molding material attached to areas other than the grooves, and then apply the molding material thereafter as is necessary. In the case of the PDP substrate, the thickness of the uniform plane portion formed on the substrate is preferably in a 10-30 μm range.

Figure 26:
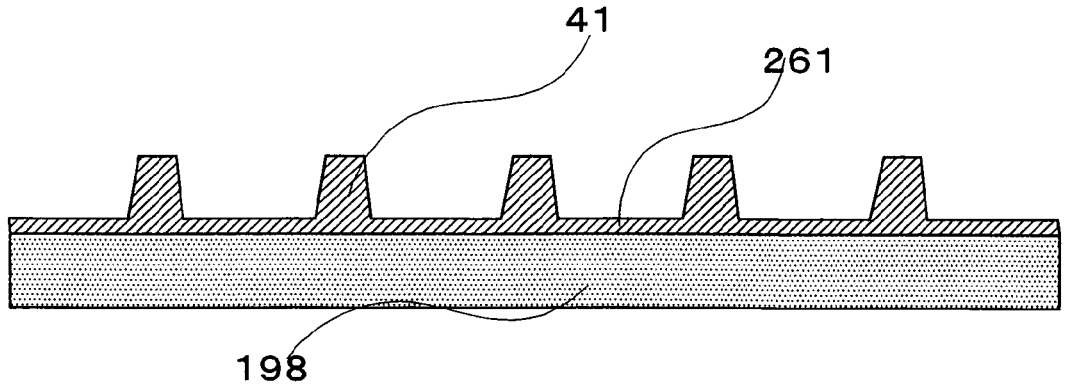
FIG. 26 is a schematic side cross-sectional view depicting a protrusion pattern linked with a uniform plane portion formed on a substrate.
Figure 27:
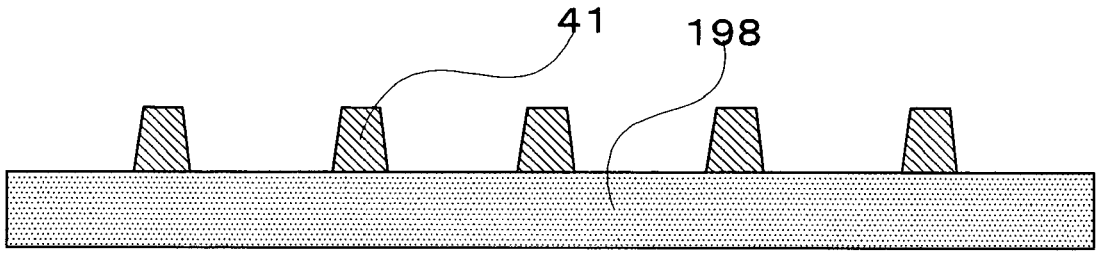
FIG. 27 is a schematic side cross-sectional view depicting a protrusion pattern formed on a substrate without a uniform plane portion.

FIG. 26 is a schematic side cross-sectional view depicting a protrusion pattern 41 linked with a uniform plane portion 261 formed on the substrate. FIG. 27, on the other hand, is a schematic side cross-sectional view depicting a protrusion pattern 41 formed on the substrate without having a uniform plane portion.

The molding material according to the present invention can be selected freely from known materials depending on the actual requirements for the protrusions to be formed on the substrate. In terms of the purpose of forming ribs on the substrate for a PDP, it is preferable that the raw material paste contains a low-melting-point glass powder, binders, etc. A heat resistant oxide or the like may be added as a filler. The viscosity of the raw material paste is preferably 50-100 P (poise) at room temperature in terms of ease of handling. The binders may contain an organic resin, solvent or both. An example of organic resin is acrylic resin. For the organic resin, one that can be cured by heat or active energy rays such as UV rays, or a combination of heat and active energy rays is preferable. A reaction initiator may also be present. If the molding material is cured after being filled into the grooves of the intaglio plate for transfer, releasing (so-called demolding) of the molding material from the grooves of the intaglio plate for transfer is easier at transfer onto the substrate and integration of the shape is improved, so such problems as molding material becoming damaged and partially remaining in the grooves of the intaglio plate for transfer (or parting of the molding material) can be prevented. If there is a possibility that curing progresses to the extreme and the degree of sticking and accordingly, adhesion of the molding material to the substrate drops, with the result that transfer probability may go down, it is preferable to take a measure to hold the curing incomplete, keeping the material in an insufficient cured or undercured status, without complete curing. Curing may be completed after the molding material is transferred onto the substrate. Examples of the solvent are terpineol, BCA (butyl carbitol acetate), etc. The integration of shape may be improved by evaporating the solvent, for example, by heating the molding material in the intaglio plate for transfer. This step may be combined further with the curing of the molding material.

Partially contacting the intaglio plate for transfer to the intaglio plate for filling can be implemented owing to the fact that the intaglio plate for filling is in the shape of a plane or cylindrical plane, and the intaglio plate for transfer is in the shape of a cylindrical plane or is bendable. In other words, if the intaglio plate for filling is a plane and the intaglio plate for transfer is in the shape of a cylindrical plane, partial contact can be implemented by contacting the intaglio plate for filling and the intaglio plate for transfer. If the intaglio plate for filling is a plane and the intaglio plate for transfer is bendable, partial contact can be implemented by bringing the intaglio plate for filling and the intaglio plate for transfer close to each other, then bending all or part of the intaglio plate for transfer. If the intaglio plate for filling is in the shape of a cylindrical plane and the intaglio plate for transfer is in the shape of a cylindrical plane, partial contact can be implemented by contacting the intaglio plate for filling and the intaglio plate for transfer. If the intaglio plate for filling is in the shape of a cylindrical plane and the intaglio plate for transfer is bendable, partial contact can be implemented by contacting the intaglio plate for filling and the bent intaglio plate for transfer.

Partial contact is sufficient only if the molding material can be shifted from the intaglio plate for filling to the intaglio plate for transfer, and normally it is unnecessary to apply extra pressure between the intaglio plate for filling and the intaglio plate for transfer.

Since the substrate according to the present invention is a plane, applying some pressure over the intaglio plate for transfer or the substrate is normally necessary after partially contacting the intaglio plate for transfer to the substrate, when the molding material is transferred from the intaglio plate for transfer to the substrate. For this purpose, it is preferable that the intaglio plate for transfer is in the shape of a cylindrical plane or is bendable. The pressure to be applied can be freely determined considering the actual conditions of transfer.

To shift the molding material smoothly from the intaglio plate for filling to the intaglio plate for transfer, it is preferable that the pattern of the concave portions of the intaglio plate for filling and the groove pattern of the intaglio plate for transfer have a positional relationship corresponding to each other. "The pattern of the concave portions of the intaglio plate for filling and the pattern of the grooves of the intaglio plate for transfer having a positional relationship corresponding to each other" means that the pattern of the grooves of the intaglio plate for transfer substantially overlap with the pattern of the concave portions of the intaglio plate for filling, or vice versa, when the intaglio plate for filling and the intaglio plate for transfer are superimposed. More specifically, it is preferable that 90% or more of the pattern of the grooves of the intaglio plate for transfer overlaps with the pattern of the concave portions of the intaglio plate for filling, or vice versa.

Figure 7:
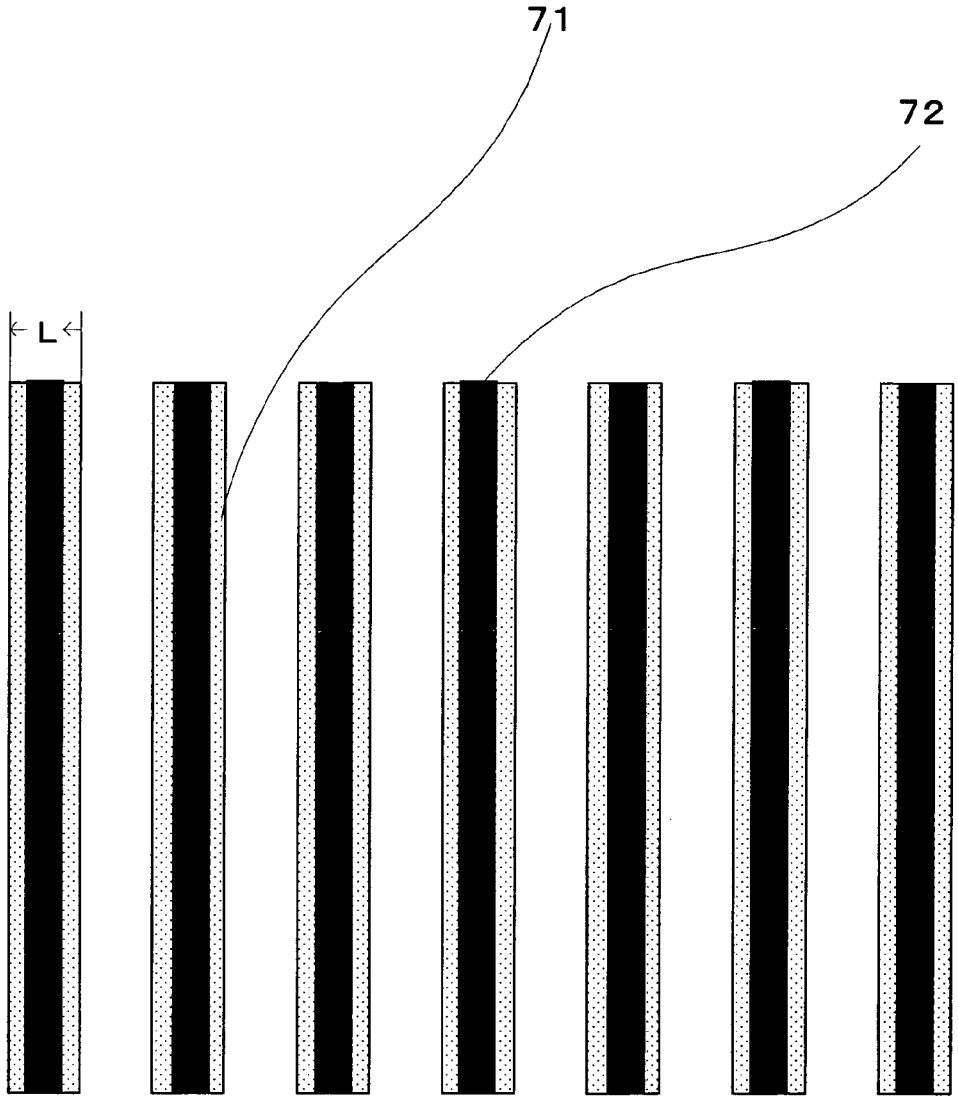
FIG. 7 is a schematic view depicting a status where the stripe pattern of the concave portions of an intaglio plate for filling and the stripe pattern of the grooves of an intaglio plate for transfer overlap.
Figure 8:
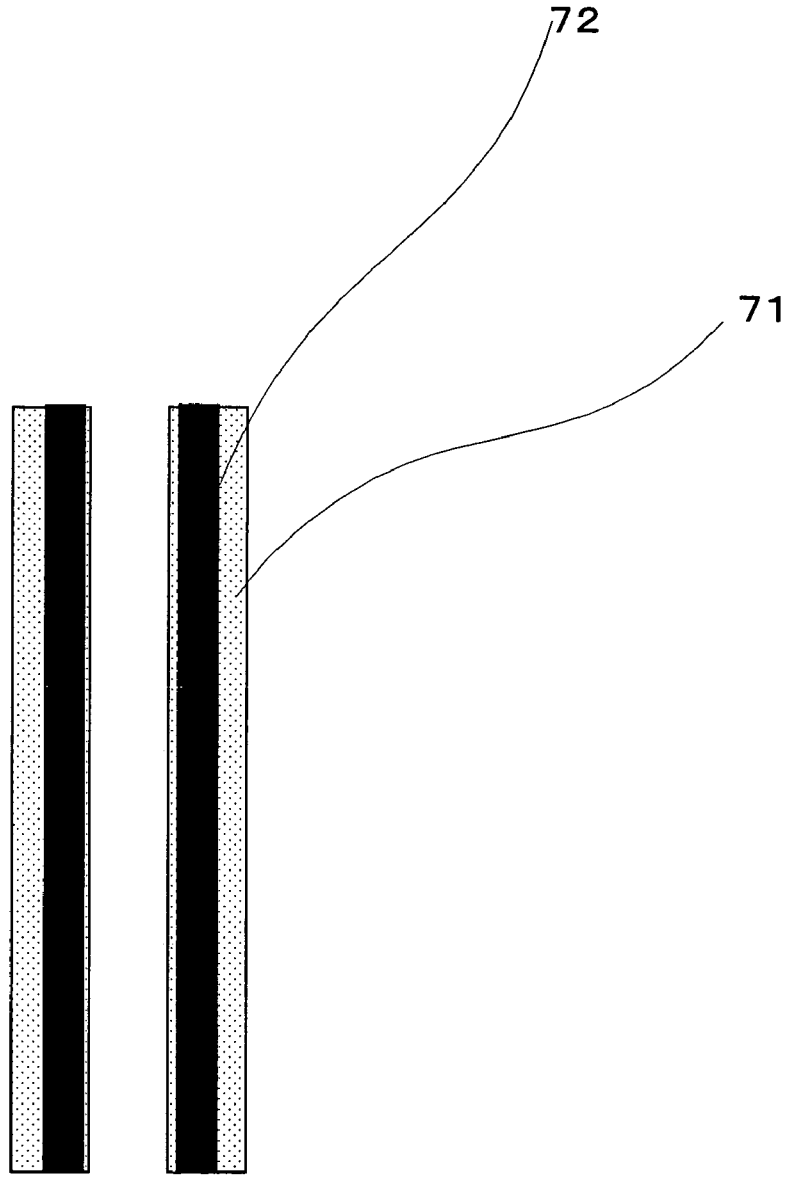
FIG. 8 is another schematic view depicting a status where the stripe pattern of the concave portions of an intaglio plate for filling and the stripe pattern of the grooves of an intaglio plate for transfer overlap.
Figure 9:
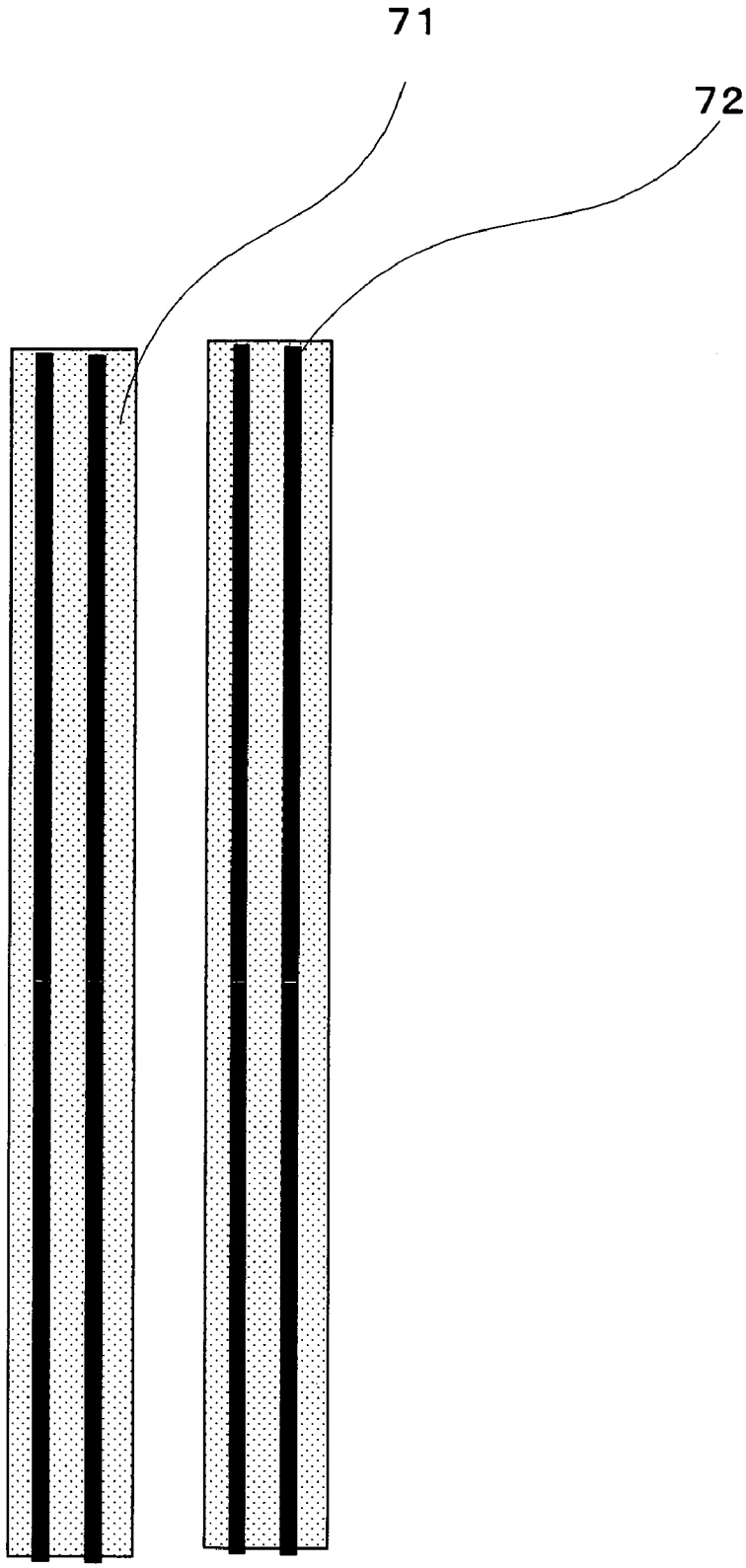
FIG. 9 is another schematic view depicting a status where the stripe pattern of the concave portions of an intaglio plate for filling and the stripe pattern of the grooves of an intaglio plate for transfer overlap.

FIG. 7 shows a status where the stripe pattern 71 of the concave portions of the intaglio plate for filling and the stripe pattern 72 of the grooves of the intaglio plate for transfer overlap. The center of overlapping need not match as shown in FIG. 7, but may be shifted as shown in FIG. 8. Also as FIG. 9 shows, a plurality of grooves of the intaglio plate for transfer may correspond to one stripe of the concave portions of the intaglio plate for filling. In this way, a case where only a part of the patterns overlap is within the scope of the present invention. If the pattern of the concave portions of the intaglio plate for filling has a repeat of concave portions, for example as dots, the concave portion being in a circular, elliptic, triangular, square, other polygonal, or irregular shape, and the set of these shapes can be regarded as a stripe pattern, then a case in which the set of these shapes that is regarded as a stripe pattern overlaps with the groove pattern of the intaglio plate for transfer, is also within the scope of the present invention. FIG. 10 shows a status where the dotted concave portions of the intaglio plate for filling that is regarded as a stripe pattern is overlapping with the stripe pattern of the grooves of the intaglio plate for transfer.

It is preferable that the overlapping occurs on the entire faces of the intaglio plate for filling and the intaglio plate for transfer, but non-overlapping portions may be included as mentioned above. Therefore if circular, elliptic, triangular, square, other polygonal and/or irregular shapes exist on the entire faces of the intaglio plate for filling, then a case in which many concave portions are included that do not overlap with the stripe pattern of the grooves of the intaglio plate for transfer, and a case in which the number of stripes of the concave portions of the intaglio plate for filling is much more than the number of grooves of the intaglio plate for transfer, with the result that many concave portions are included that do not overlap with the stripe pattern of the grooves of the intaglio plate for transfer are also within the scope of the present invention.

If the relative position alignment of the intaglio plate for transfer and the intaglio plate for filling are expected to be difficult, a gravure printing plate, which has no relationship to the patterns of the intaglio plate for transfer, may be used as a pattern for the intaglio plate for filling. A gravure printing plate is a plate used for gravure printing, and is a metal plate where 50 to several hundred μm square or circular concave portions are arrayed. Instead of this, a screen mesh with 50 to several hundred μm square openings with a 50 to several hundred μm thickness which is set on the surface of a base plate or a roll, may be used as the intaglio plate for filling.

Figure 11:
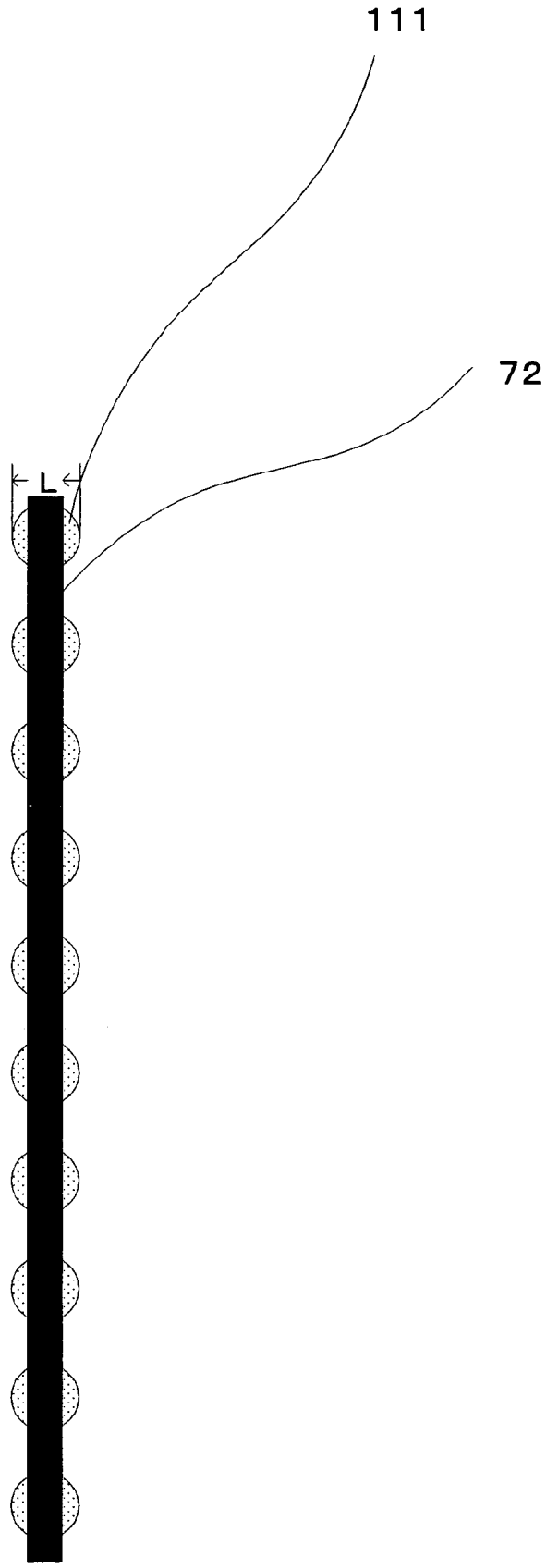
FIG. 11 is another schematic view depicting a status where the stripe pattern of the concave portions of an intaglio plate for filling and the stripe pattern of the grooves of an intaglio plate for transfer overlap.

For the three-dimensional shape of the concave portion of the intaglio plate for filling, it is preferable that the length of a concave portion of the intaglio plate for filling in a direction along the groove width of the intaglio plate for transfer is longer than the groove width of the intaglio plate for transfer. By this, the concave portions of the intaglio plate for filling can easily contact the grooves of the intaglio plate for transfer, and the filling of the molding material by the capillary phenomenon becomes smooth. The length of the concave portion of the intaglio plate for filling in a direction along the groove width of the intaglio plate for transfer refers to length L in FIG. 7 and FIG. 11. In the case of a set of a plurality of shapes, the individual concave portion 111, shown in FIG. 11, is judged.

It is also preferable that the depth of the grooves of the intaglio plate for transfer is deeper than the depth of the concave portion of the intaglio plate for filling. This is because the filling of the molding material by the capillary phenomenon becomes smooth. It is preferable to satisfy both of the above mentioned conditions. These conditions need not be established for the entire faces of the intaglio plate for filling and the intaglio plate for transfer, but generally it is more preferable as the portions, where the conditions establish, increase.

According to the above mentioned molding material transfer method and substrate manufacturing method, a new highly reliable technology for manufacturing a substrate having a protrusion pattern such as a substrate of a PDP, can be provided. The molding material can be filled into the grooves of the intaglio plate for transfer with certainty, and the structural defects caused by the involvement of bubbles during the formation of the protrusion pattern, can be decreased considerably. Therefore the reliability of the products and the yield of the products can be improved. Also off-line steps such as vacuum deaeration are unnecessary, which improves the production efficiency and simplifies the processing steps. It is particularly preferable to apply such substrates to gas discharge panels and gas discharge panel display devices that use substrates having ribs.

Preferred examples of an apparatus for implementing the above mentioned technology are a molding material transfer apparatus comprising a plate cylinder, an intaglio plate for filling, an intaglio plate for transfer, an intaglio-plate-for-transfer contacting mechanism for partially contacting the intaglio plate for filling and the intaglio plate for transfer, a molding material curing unit, and a film thickness adjustment mechanism for the molding material on the surface of the intaglio plate for transfer, if necessary, and a substrate manufacturing apparatus comprising a plate cylinder, an intaglio plate for filling, an intaglio plate for transfer, a substrate, an intaglio-plate-for-transfer contacting mechanism for partially contacting the intaglio plate for filling and the intaglio plate for transfer, a substrate contacting mechanism for contacting the intaglio plate for transfer and the substrate, a molding material curing unit, and, if necessary, a film thickness adjustment mechanism for the molding material on the surface of the intaglio plate for transfer. If such apparatuses are used, the molding material can be easily filled into the grooves of the intaglio plate for transfer, by filling the molding material paste into the concave portions of the intaglio plate for filling and partially contacting the intaglio plate for transfer on which a specific groove pattern is formed, to the intaglio plate for filling. Also by contacting the intaglio plate for transfer to the substrate, the molding material can be easily transferred as a protrusion pattern from the intaglio plate for transfer to the substrate.

A plate cylinder may be shared for filling the molding material from the intaglio plate for filling into the intaglio plate for transfer, and for transferring the molding material as a protrusion pattern from the intaglio plate for transfer to the substrate, or different plate cylinders may be used. The intaglio plate for transfer may be set on the plate cylinder, but may not be used as mentioned later.

The molding material curing unit is a unit having a function to cure the molding material, and any known device, such as a hot air blower and UV-ray irradiation device that can cure the molding material, can be used.

The film thickness adjustment mechanism for the molding material is a mechanism for implementing a protrusion pattern which is linked with a uniform plane portion, and any known device that can coat a given thickness of the molding material on the face of the intaglio plate for transfer can be used.

The intaglio-plate-for-transfer contacting mechanism for partially contacting the intaglio plate for filling and the intaglio plate for transfer may be any known mechanism if the intaglio plate for filling and the intaglio plate for transfer can be partially contacted in the above described sense. In a case where both the intaglio plate for filling and the intaglio plate for transfer are set on plate cylinders or where the intaglio plate for filling is set on a plate cylinder and the intaglio plate for transfer is set on a table, it is sufficient if the mechanism can move one or both of these plate cylinders, or one or both of the plate cylinder and the table. In a case where the intaglio plate for transfer can be partially deformed, it is sufficient if the mechanism can deform a part of the intaglio plate for transfer.

For the substrate contacting mechanism for contacting the intaglio plate for transfer and the substrate, any mechanism can be used if the intaglio plate for transfer and the substrate can be partially contacted in the above described sense. In a case where the intaglio plate for transfer is set on a plate cylinder, it is sufficient if the mechanism can move one or both of the plate cylinder and the table on which the substrate is set. In a case where the intaglio plate for transfer can be partially deformed, it is sufficient if the mechanism can deform a part of the intaglio plate for transfer. The significances of the other elements are as described above.

EXAMPLES

Examples of the present invention will now be described in detail. In the following examples, the concave pattern of the intaglio plate for filling and the groove pattern formed on the intaglio plate for transfer are lattice patterns and have a cross-section that is rectangular with tapered angles (that is trapezoidal). In this case, the concave portions of the intaglio plate for filling can be called grooves, just like the case of the intaglio plate for transfer, so in the examples the concave portions of the intaglio plate for filling may be called "grooves".

Example 1

Figure 12:
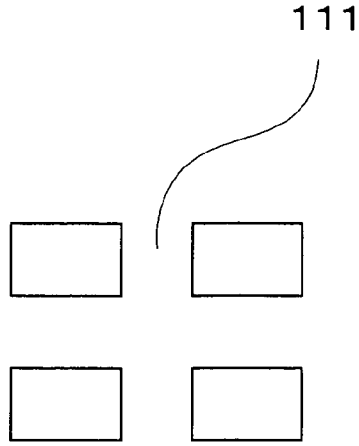
FIG. 12 is a schematic plan view depicting the concave portions of an intaglio plate for filling.
Figure 13:
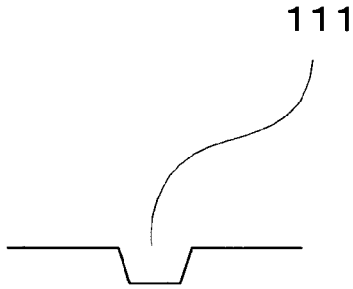
FIG. 13 is a side cross-sectional view of FIG. 12.
Figure 14:
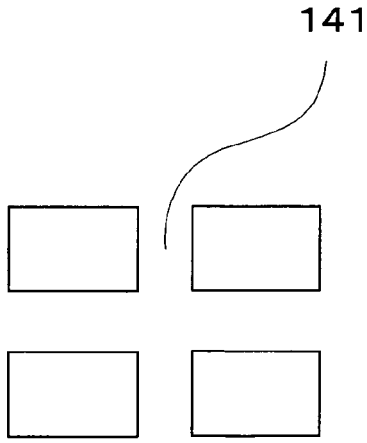
FIG. 14 is a schematic plan view depicting the grooves of an intaglio plate for transfer.
Figure 15:
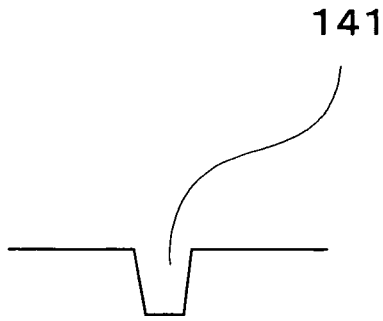
FIG. 15 is a side cross-sectional view of FIG. 14.
Figure 16:
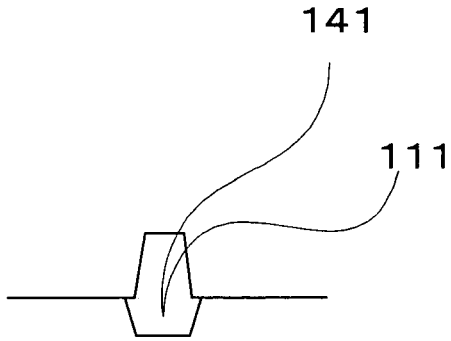
FIG. 16 is a schematic side cross-sectional view depicting a status where the concave portions of an intaglio plate for filling mate with the grooves of an intaglio plate for transfer.

In this example, the principle of the present invention will be described with reference to FIG. 12 to FIG. 16. FIG. 12 is a schematic plan view depicting the concave portions 111 of the intaglio plate for filling. FIG. 13 is a schematic side cross-sectional view thereof, FIG. 14 is a schematic plan view depicting the grooves 141 of the intaglio plate for transfer, FIG. 15 is a schematic side cross-sectional view thereof, and FIG. 16 is a schematic side cross-sectional view depicting a status where the concave portions 111 of the intaglio plate for filling and the grooves 141 of the intaglio plate for transfer are met. In FIG. 12 to FIG. 16, the groove patterns formed on the intaglio plate for filling and the intaglio plate for transfer are both lattices, and these shapes overlap with each other when the intaglio plate for filling and the intaglio plate for transfer are superimposed. The dimensions in FIG. 12 and the dimensions in FIG. 14 are in a 1:1 relationship, and as a comparison of FIG. 12 and FIG. 14 shows, the groove width of the intaglio plate for filling is wider than the groove width of the intaglio plate for transfer. Also the dimensions of FIG. 13 and the dimensions of FIG. 15 have a 1:1 relationship, and as FIG. 16 shows, the groove width of the intaglio plate for transfer is greater than the depth of the grooves of the intaglio plate for filling. The reason is as mentioned above.

Figure 17:
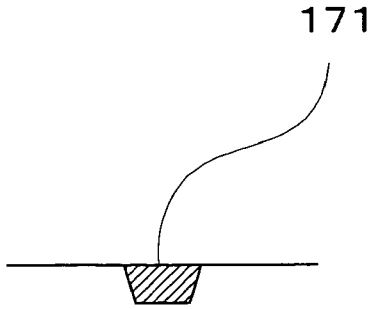
FIG. 17 is a schematic view depicting an status where a molding material is filled into the concave portion of an intaglio plate for filling.

According to the molding material transfer method, a molding material paste is first filled into the grooves of the intaglio plate for filling. Specifically, the molding material paste is filled into the intaglio plate for filling using a metal blade, for example. The molding material may be filled a plurality of times if necessary. FIG. 17 is a schematic view depicting a status where the molding material 171 is filled into a groove of the intaglio plate for filling.

Figure 18:
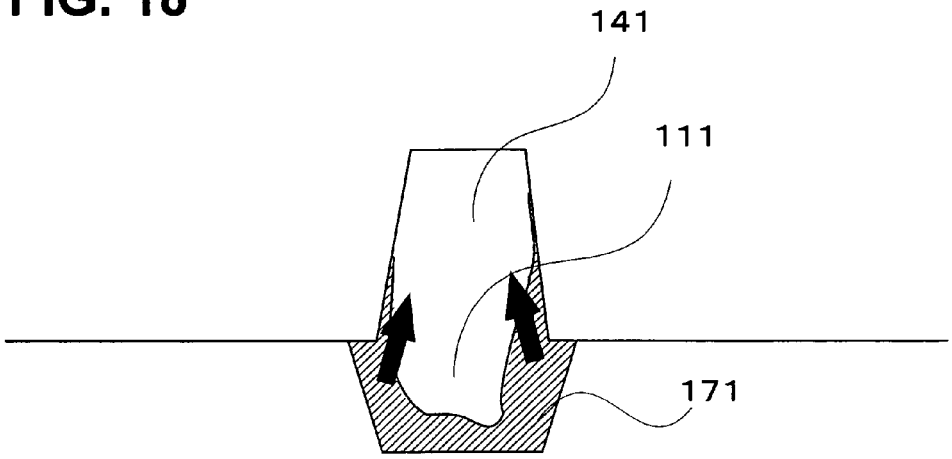
FIG. 18 is a schematic view depicting a status where a molding material is flowing as the molding material is filled into the grooves of an intaglio plate for transfer.

Then a part of the intaglio plate for transfer on which a specific groove pattern is formed, is slowly contacted to the intaglio plate for filling. By this, the capillary phenomenon occurs, and the molding material flows as shown by the arrows in FIG. 18, and is filled into the grooves of the intaglio plate for transfer. Since the capillary phenomenon progresses as sequentially wetting the walls of the grooves of the intaglio plate for transfer, the involvement of bubbles can be prevented. As the capillary phenomenon progresses, gas existing at 141 in FIG. 18 moves to the front or rear side on FIG. 18 where the molding material has not been filled, so gas does not remain as bubbles.

Example 2

In this example, a molding material transfer apparatus and a substrate manufacturing apparatus in the case where the intaglio plate for filling is in the shape of a plane and the intaglio plate for transfer is bendable into be a cylindrical plane, and how to use these apparatuses, will be described.

Figure 19:
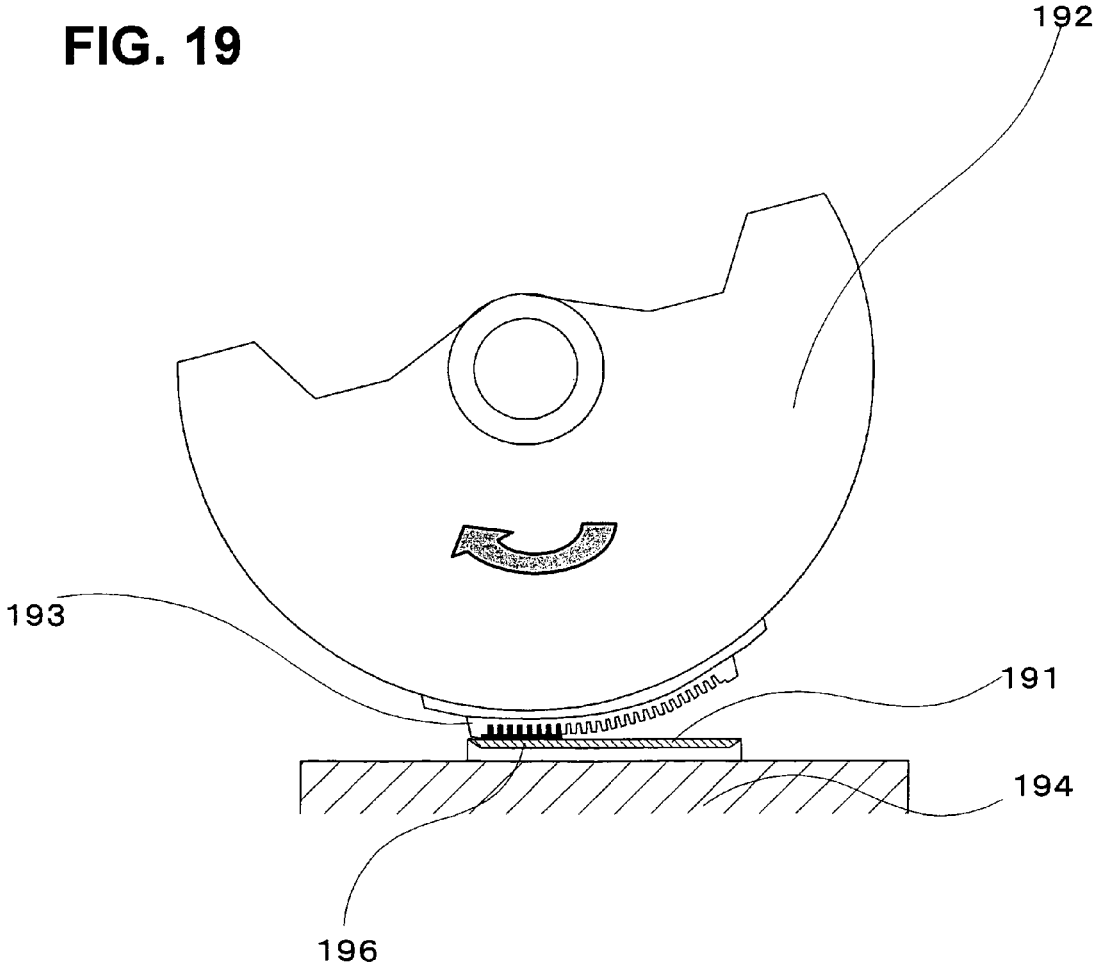
FIG. 19 is a schematic view depicting a status where an intaglio plate for transfer in the shape of a cylindrical plane is attached to a plate cylinder, and an intaglio plate for filling is placed on a flat table.

FIG. 19 shows a status where a molding material is being filled from an intaglio plate for filling 191 placed on a flat table 194 into an intaglio plate for transfer 193 installed on a plate cylinder 192 which is in the shape of a cylindrical plane. In the grooves of the intaglio plate for filling 191, the molding material has been filled in advance. As the plate cylinder 192 rotates in the arrow direction, the intaglio plate for transfer 193 and the intaglio plate for filling 191 are partially contacted, the molding material shifts from the grooves of the intaglio plate for filling 191 to the grooves of the intaglio plate for transfer 193 by the capillary phenomenon, and the grooves of the intaglio plate for transfer 193 are filled with the molding material. The reference numeral 196 shows the portion where the intaglio plate for filling 191 and the intaglio plate for transfer 193 are partially contacting. The intaglio-plate-for-transfer contacting mechanism for partially contacting the intaglio plate for filling 191 and the intaglio plate for transfer 193 are not illustrated. Actually, the contact portion 196 of the intaglio plate for filling 191 and the intaglio plate for transfer 193 is very small, and it is preferable that the contact portion is a line contact that is almost a point contact, when viewed as depicted in FIG. 19.

Figure 20:
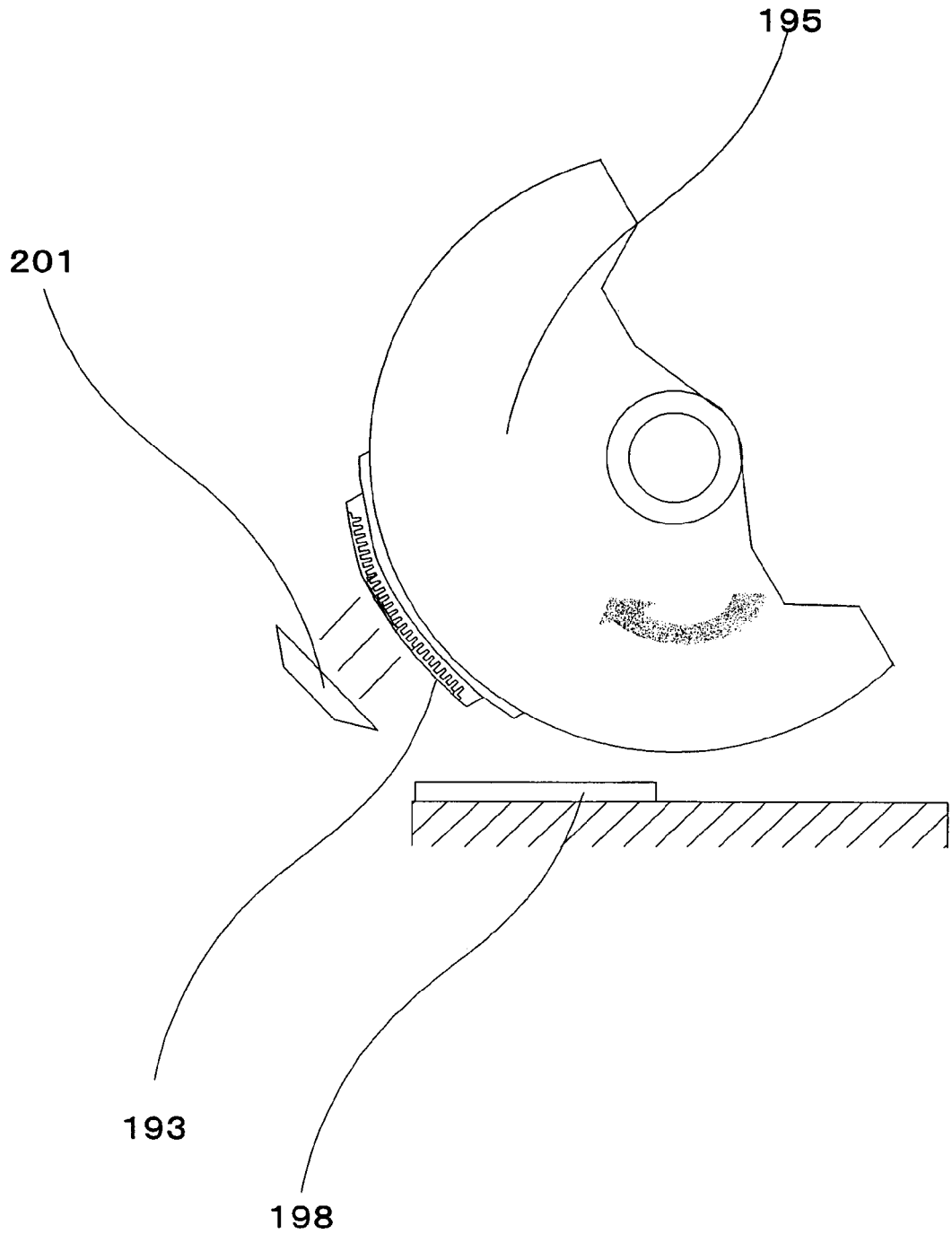
FIG. 20 is a schematic view depicting a status where an intaglio plate for transfer is bent into the shape of a cylindrical face and is attached to a plate cylinder.

FIG. 20 shows a status where an intaglio plate for transfer 193 is installed on a plate cylinder 195 and a molding material is being cured by the UV-ray irradiation from a UV-ray irradiation unit 201. The UV-ray irradiation unit 201 corresponds to the molding material curing unit according to the present invention. Equipment the same as FIG. 19 may be used for the main equipment such as the plate cylinder 195 in this step. The molding material has not yet been transferred to the substrate 198.

Figure 21:
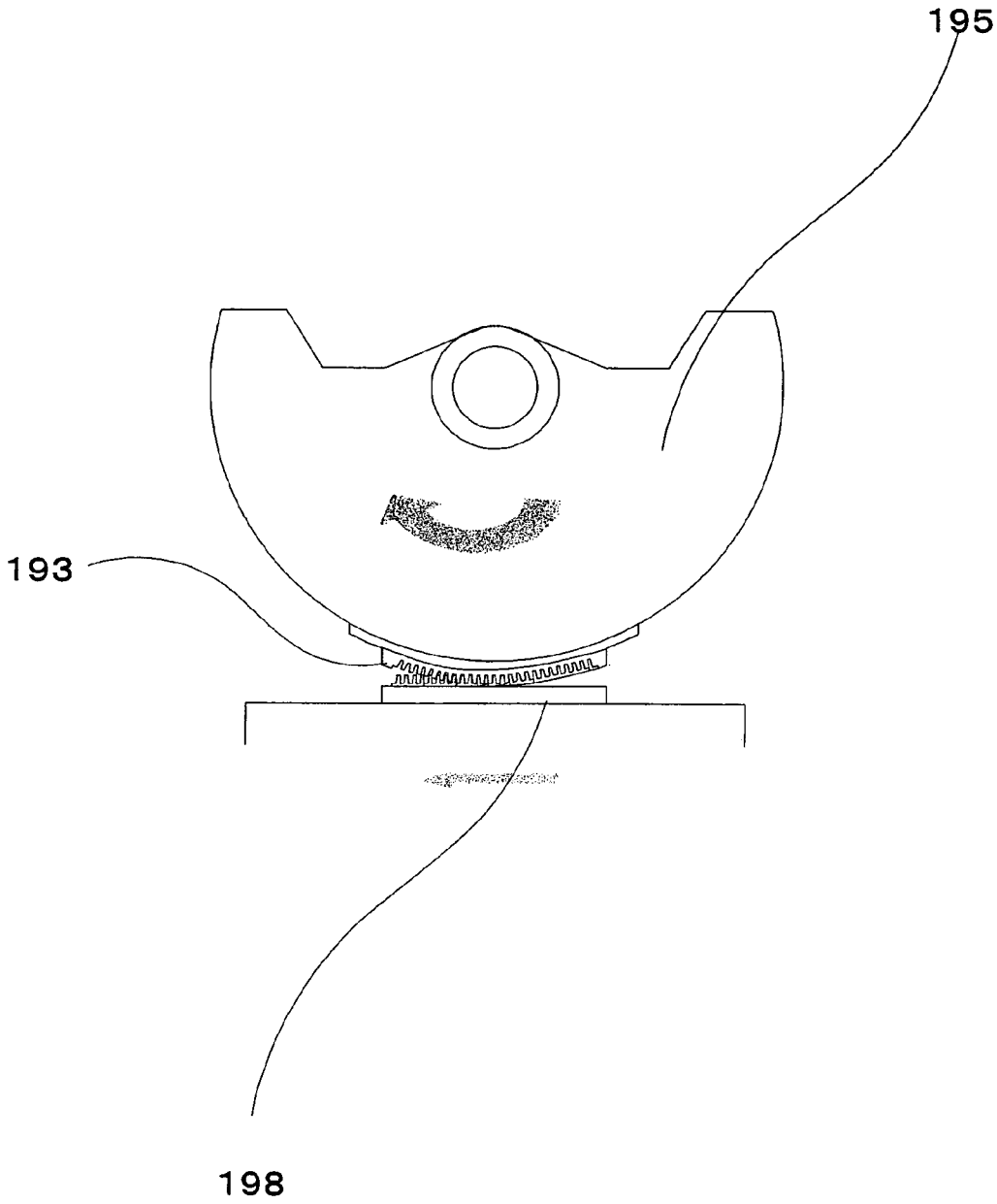
FIG. 21 is a schematic view depicting a status where a molding material is being transferred from an intaglio plate for transfer to a substrate.

FIG. 21 shows a status where a molding material is being transferred from an intaglio plate for transfer 193 to a substrate 198. The substrate contacting mechanism for contacting the intaglio plate for transfer 193 and the substrate 198 is not illustrated.

Example 3

In this example, a molding material transfer apparatus and a substrate manufacturing apparatus, in the case where an intaglio plate for filling is a plane and an intaglio plate for transfer is bendable, and how to uses these apparatuses, will be described.

Figure 22:
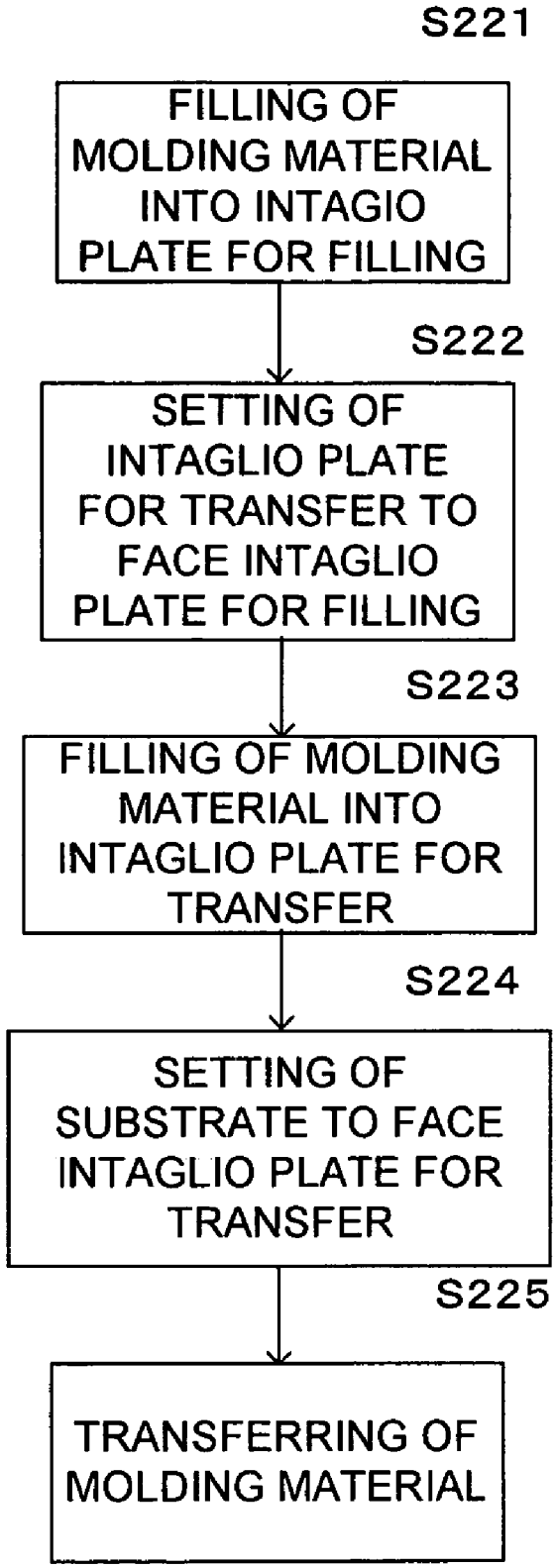
FIG. 22 is a flow chart depicting the filling and the transfer of a molding material according to the present invention.
Figure 23A:
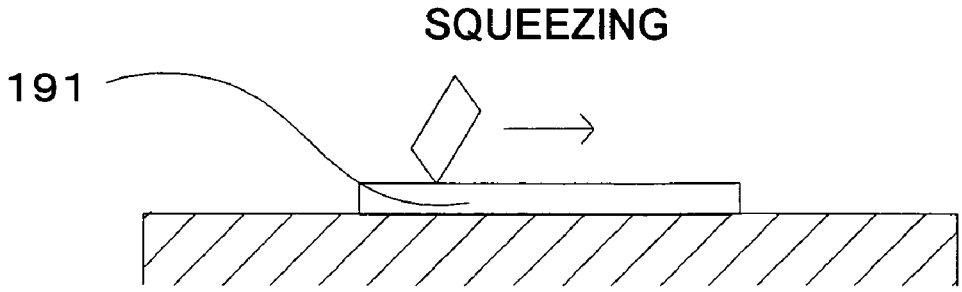
FIG. 23A is a schematic view depicting a status of filling a molding material into an intaglio plate for filling.

First according to step S221 in FIG. 22, a molding material is filled into an intaglio plate for filling 191 by squeezing as shown in FIG. 23A.

Figure 23B:
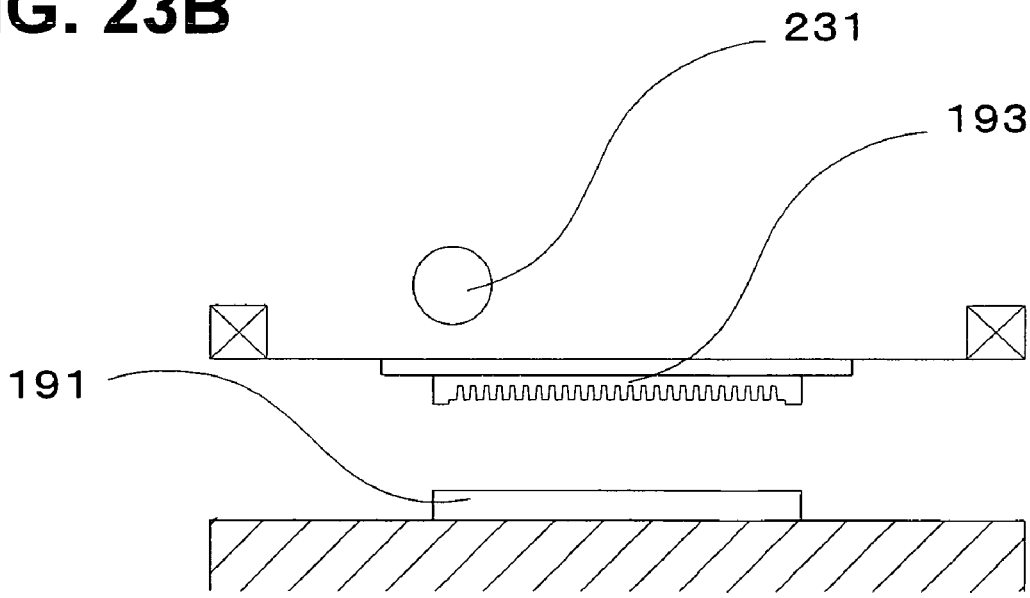
FIG. 23B is a schematic view depicting a status where an intaglio plate for transfer is set facing an intaglio plate for filling.

Then according to step S222 in FIG. 22, an intaglio plate for transfer 193 is set facing the intaglio plate for filling 191 as shown in FIG. 23B.

Figure 23C:
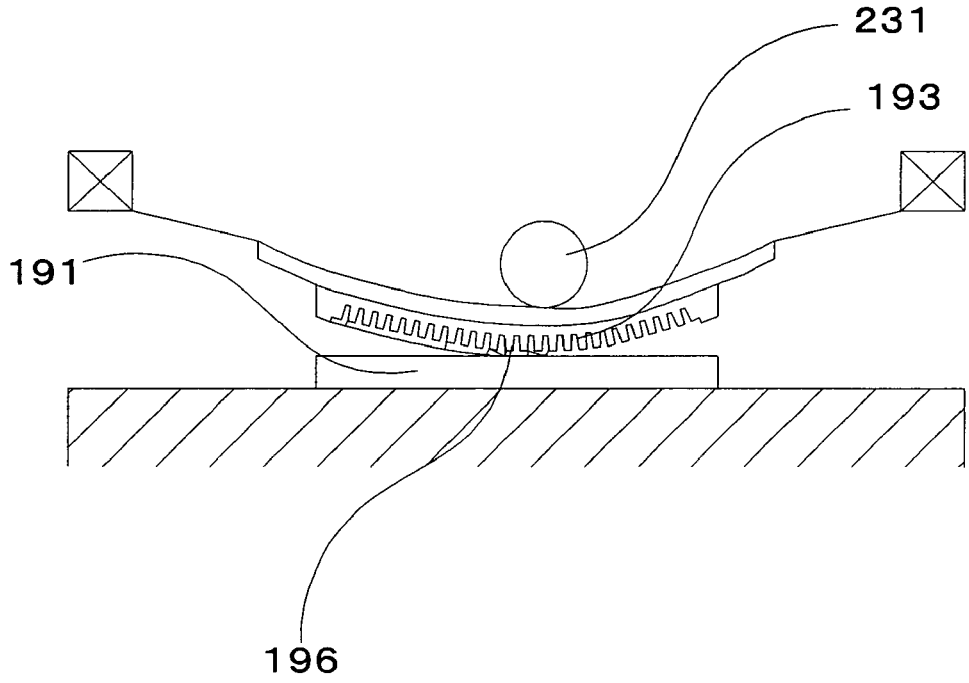
FIG. 23C is a schematic view depicting a status where a molding material is shifted from the concave portions of an intaglio plate for filling to the grooves of an intaglio plate for transfer.

Then according to step S223 in FIG. 22, the intaglio plate for transfer 193 is bent using a roller 231 as shown in FIG. 23C, so that the intaglio plate for filling 191 and the intaglio plate for transfer 193 are partially contacted, and the molding material is shifted from the grooves of the intaglio plate for filling 191 to the grooves of the intaglio plate for transfer 193 by the capillary phenomenon, and the grooves of the intaglio plate for transfer 193 are filled with the molding material. The roller 231 corresponds to the intaglio-plate-for-transfer contacting mechanism.

Figure 23D:
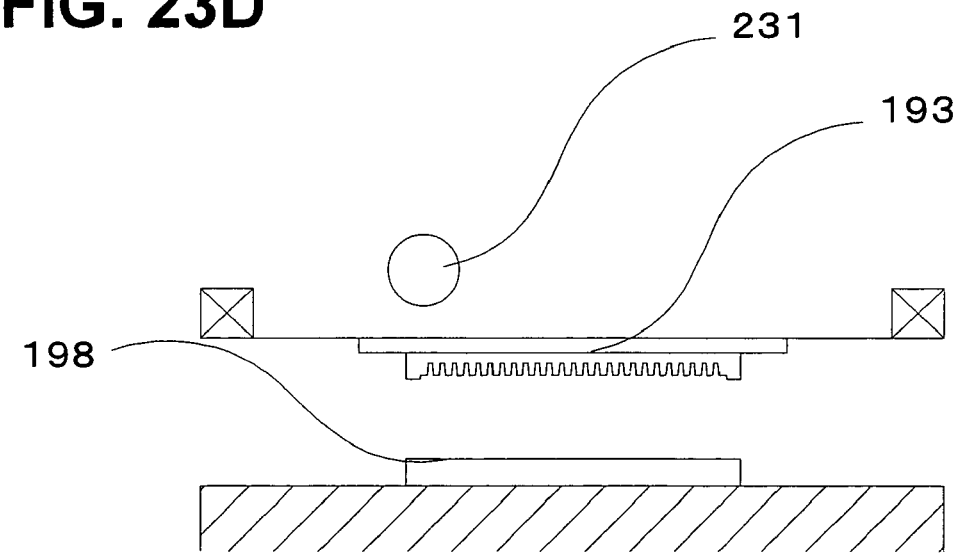
FIG. 23D is a schematic view depicting a status where a substrate is set facing an intaglio plate for transfer.
Figure 23E:
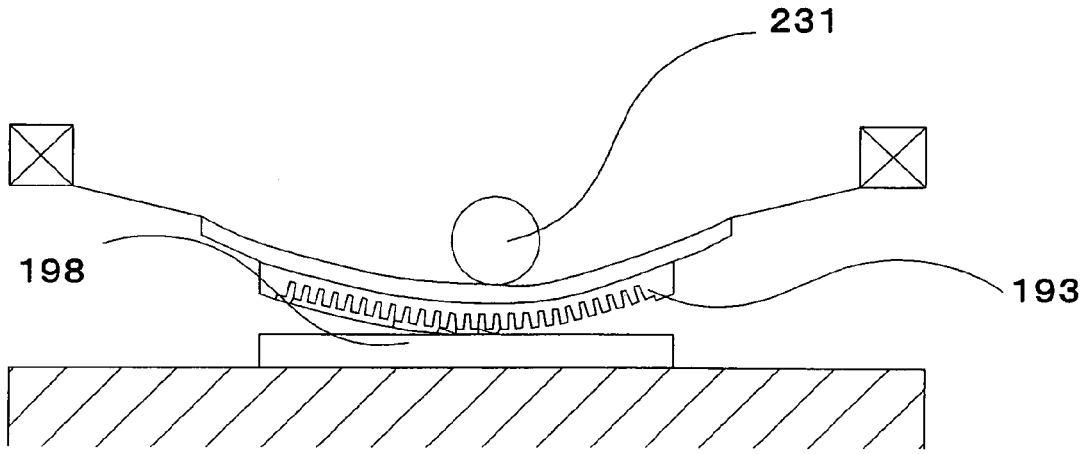
FIG. 23E is a schematic view depicting a status of transferring a molding material from an intaglio plate for transfer to a substrate.

Then according to step S224 in FIG. 22, a substrate 198 is set instead of the intaglio plate for filling 191 in FIG. 23B as shown in FIG. 23D, and according to step S225 in FIG. 22, the intaglio plate for transfer 193 is bent using the roller 231 as shown in FIG. 23E, so that the intaglio plate for transfer 193 and the substrate 198 are partially contacted, and the molding material is transferred from the intaglio plate for transfer 193 to the substrate 198 by applying slight pressure. The roller 231 in this case corresponds to the substrate contacting mechanism. A hot air blowing or UV-ray irradiation step may be inserted between step S223 and step S225 in FIG. 22.

Example 4

Figure 24:
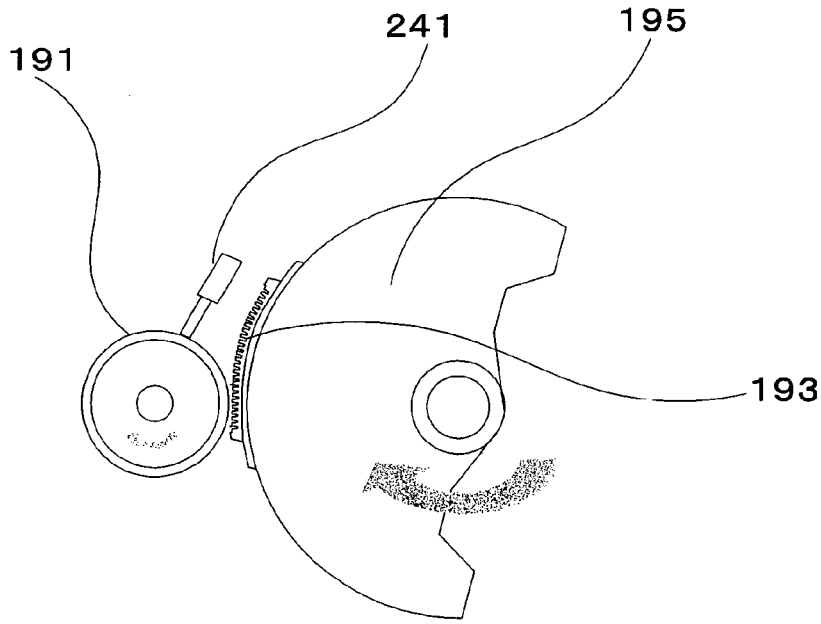
FIG. 24 is a schematic view depicting an example in which an intaglio plate for filling 191 itself is cylindrical.

In this example, a molding material transfer apparatus and a substrate manufacturing apparatus, in the case where an intaglio plate for filling is in the shape of a cylindrical plane and an intaglio plate for transfer is bendable into a cylindrical plane, and how to use these apparatuses, will be described. FIG. 24 shows a case where an intaglio plate for filling 191 itself is a cylindrical shape and an intaglio plate for transfer 193 which is bent into a cylindrical plane, is installed on a plate cylinder. On the intaglio plate for filling 191, a blade 241 for scraping off the excessive molding material is attached. For the intaglio plate for filling, a gravure roll, which has mass distribution throughout the industry, may be used. This combination can be used for shifting and filling the molding material from the intaglio plate for filling into the intaglio plate for transfer. For example, this combination may be used instead of the molding material filling steps of Example 2 and Example 3.

Example 5

Figure 25:
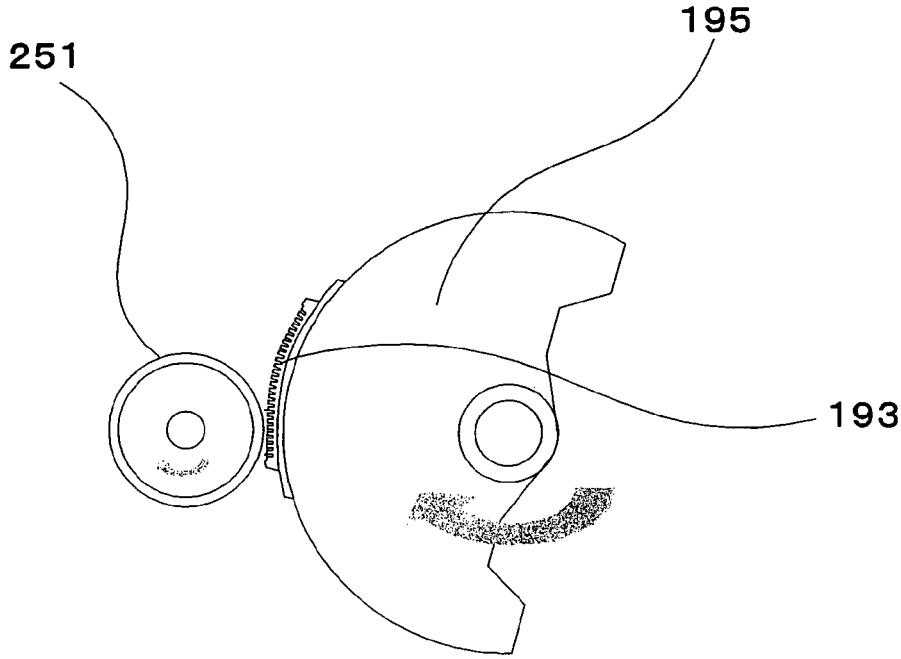
FIG. 25 is a schematic view depicting a status in which an intaglio plate for transfer is being coated by a coating roll.

In this example, a molding material transfer apparatus and a substrate manufacturing apparatus in the case where a predetermined thickness of molding material is applied onto the surface of an intaglio plate for transfer after filling the molding material into the intaglio plate for transfer using the capillary phenomenon, and how to use these apparatuses, will be described. FIG. 25 shows a status where a predetermined thickness of a molding material is applied onto an intaglio plate for transfer according to the roll coating method, by making a molding material on a coating roll 251 contact with the intaglio plate for transfer 193. The coating roll 251 corresponds to the film thickness adjustment mechanism for the molding material. Instead of the roll coating method, a slit coating method, where the material is injected from slits, may be used. With these methods, the thickness of the molding material can generally be easily adjusted.

What is claimed is:

1. A molding material transfer method comprising:

filling a molding material in a form of a paste into concave portions in a flat face of a first intaglio plate;

partially contacting a second intaglio plate on which a specific pattern of grooves is formed, to the face of said first intaglio plate, and transferring, in this contacting status, the molding material in the concave portions of said first intaglio plate into the grooves of said second intaglio plate by capillary phenomenon; and transferring the molding material in the grooves of said second intaglio plate onto a substrate to receive the transferred material as protrusions.

2. The molding material transfer method according to claim 1, further comprising applying a material with a desired thickness onto the surface of said second intaglio plate after transferring the molding material from the concave portions of said first intaglio plate into the grooves of said second intaglio plate.

3. The molding material transfer method according to claim 1, wherein a pattern of the concave portions of said first intaglio plate and the pattern of the grooves of said second intaglio plate have a positional relationship corresponding to each other.

4. The molding material transfer method according to claim 1, wherein a depth of the concave portions of said first intaglio plate is shallower than a depth of the grooves of said second intaglio plate, and an opening area of the concave portion of said first intaglio plate is wider than an opening area of a groove of said second intaglio plate.

5. The molding material transfer method according to claim 1, wherein the concave portions of said first intaglio plate are a plurality of dots, and said plurality of dots of the first intaglio plate and the pattern of the grooves of said second intaglio plate have a positional relationship corresponding to each other.

6. The molding material transfer method according to claim 1, wherein said first intaglio plate is in the shape of a plane or cylindrical plane, and said second intaglio plate is in the shape of a cylindrical plane or is bendable.

7. A substrate structure for a plasma display panel, manufactured by a manufacturing method including the transfer method according to claim 1, wherein said protrusions are ribs to partition a discharge space.

8. A molding material transfer method comprising:

filling a molding material paste into concave portions in a face of a first plate;

partially contacting a second plate having grooves to the face of said first plate;

transferring the molding material from the first plate to the grooves of the second plate by a capillary phenomenon; and transferring the transferred molding material from the grooves of the second plate onto a substrate as protrusions.

9. A molding material transfer method for manufacturing of a substrate for a plasma display panel comprising:

filling a molding material in a form of a paste into concave portions in a flat face of a first intaglio plate;

partially contacting a second intaglio plate on which a specific pattern of grooves is formed to the face of said first intaglio plate, and transferring, in this contacting status, the molding material in the concave portions of the first intaglio plate into the grooves of said second intaglio plate by a capillary phenomenon, wherein a pattern of the concave portions of the first intaglio plate and a pattern of the grooves of the second intaglio plate have a positional relationship correspond to each other; and transferring the molding material in the grooves of said second intaglio plate onto the substrate so as to form a barrier rib having a pattern corresponding to the specific pattern of the grooves.

10. The molding material transfer method according to claim 9, further comprising applying an additional material with a desired thickness onto the surface of said second intaglio plate after transferring the molding material in the concave portions of said first intaglio plate into the grooves of said second intaglio plate, and transferring the additional material and the molding material from the second intaglio plate onto the substrate.

* * * * *

UNITED STATES PATENT AND TRADEMARK OFFICE

CERTIFICATE OF CORRECTION

PATENT NO. : 7,530,305 B2
APPLICATION NO. : 11/174459
DATED : May 12, 2009
INVENTOR(S) : Osamu Toyoda et al.

It is certified that error appears in the above-identified patent and that said Letters Patent is hereby corrected as shown below:

Column 14, Line 64, change “by” to --by a--.

Signed and Sealed this

Fourth Day of August, 2009

JOHN DOLL
*Acting Director of the United States Patent and Trademark Office*